US008123468B2

(12) United States Patent
Shirahama et al.

(10) Patent No.: US 8,123,468 B2
(45) Date of Patent: Feb. 28, 2012

(54) CENTRIFUGAL FAN

(75) Inventors: Seiji Shirahama, Aichi (JP); Kazuo Ogino, Aichi (JP); Yasuji Tsubakishita, Aichi (JP); Akira Sadamoto, Aichi (JP)

(73) Assignee: Panasonic Corporation, Osaka (JP)

( * ) Notice: Subject to any disclaimer, the term of this patent is extended or adjusted under 35 U.S.C. 154(b) by 466 days.

(21) Appl. No.: 12/446,547

(22) PCT Filed: Oct. 30, 2007

(86) PCT No.: PCT/JP2007/071075

§ 371 (c)(1),
(2), (4) Date: Apr. 21, 2009

(87) PCT Pub. No.: WO2008/053867

PCT Pub. Date: May 8, 2008

(65) Prior Publication Data

US 2010/0189547 A1 Jul. 29, 2010

(30) Foreign Application Priority Data

| | | |
|---|---|---|
| Nov. 2, 2006 | (JP) | 2006-298640 |
| Nov. 2, 2006 | (JP) | 2006-298641 |
| Sep. 20, 2007 | (JP) | 2007-243233 |
| Sep. 20, 2007 | (JP) | 2007-243234 |

(51) Int. Cl.
*F04D 29/66* (2006.01)

(52) U.S. Cl. ..... 415/119

(58) Field of Classification Search ..... 415/119, 415/208.2, 208.1, 213.1; 181/224, 226, 202, 181/225; 417/312, 366, 410.1, 423.2; 454/354, 454/356

See application file for complete search history.

(56) References Cited

U.S. PATENT DOCUMENTS

| | | | | |
|---|---|---|---|---|
| 3,330,379 | A * | 7/1967 | Cook | 181/224 |
| 5,110,266 | A * | 5/1992 | Toyoshima et al. | 417/312 |
| 5,326,317 | A * | 7/1994 | Ishizu et al. | 454/354 |
| 5,454,690 | A * | 10/1995 | Wolfe et al. | 415/119 |
| 5,620,370 | A | 4/1997 | Umai et al. | |
| 6,171,079 | B1 * | 1/2001 | Gross et al. | 417/423.12 |
| 7,644,803 | B2 * | 1/2010 | Hashizume | 181/225 |

FOREIGN PATENT DOCUMENTS

| | | | |
|---|---|---|---|
| JP | 02-070137 | U | 5/1990 |
| JP | 02-77532 | U | 6/1990 |
| JP | 04-001349 | U | 1/1992 |
| JP | 04-041996 | A | 2/1992 |
| JP | 04-309738 | A | 2/1992 |
| JP | 04-265500 | A | 9/1992 |
| JP | 07-158923 | A | 6/1995 |
| JP | 08-094146 | A | 4/1996 |

* cited by examiner

OTHER PUBLICATIONS

International Search Report of PCT Application No. PCT/JP2007/071075 dated Jan. 22, 2008.

*Primary Examiner* — Alexander Gilman

(74) *Attorney, Agent, or Firm* — Panasonic Patent Center; Dhiren Odedra; Kerry Culpepper

(57) ABSTRACT

A centrifugal fan used as a ventilating fan is provided which can increase a range of frequencies of noises in which noises can be suppressed and can adjust frequencies of noises at which noises can be suppressed. The centrifugal fan includes, in an outer casing, a motor that couples an impeller, a casing that surrounds a periphery of the impeller and has a bell-mouthed suction port on one side, and a bell-mouthed orifice that has an opening that is concentric with the suction port and has a diameter equal to or smaller than that of the suction port, wherein a member closing a clearance portion between an end of the orifice and the casing is a noise absorbing structural material, and a space formed by the orifice is a rear air layer, thereby forming a resonance type noise absorbing structure.

24 Claims, 21 Drawing Sheets

CENTRIFUGAL FAN

TECHNICAL FIELD

The present invention relates to a centrifugal fan used as a ventilating fan or the like.

BACKGROUND ART

There has conventionally been known such a centrifugal fan that is used as a centrifugal fan and has an orifice different from a suction casing with a bell-mouthed suction port at an opening on one side of an outer casing. An example of such a centrifugal fan in the related art is described in Patent Document 1.

The centrifugal fan in the related art will be described below with reference to FIG. 31.

As illustrated in FIG. 31, the centrifugal fan in the related art has outer casing 101 having one opened side, motor 104 that has impeller 103 fixed to top surface 102 in outer casing 101, casing 105 that surrounds a periphery of impeller 103, and suction casing 107 having suction port 106. Orifice 109 has suction hole 108 having a diameter equal to or smaller than that of suction port 106. Orifice 109 is separated from suction casing 107 by predetermined clearance h. Orifice 109 configures resonant space 112 so that lower end 110 of suction casing 107 and end 111 of orifice 109 are separated by clearance distance i. Grill 113 is provided on one side of orifice 109. Discharge port 114 is provided on one side of outer casing 101.

In the above configuration, when impeller 103 is rotated, sucked air passes from grill 113 through suction hole 108 of orifice 109 and then enters impeller 103 from suction port 106 of suction casing 107. The sucked air is subjected to pressure rise by impeller 103. The sucked air passes through an inside of casing 105 and is then discharged from discharge port 114. Sound waves of rotational noises caused when the sucked air is subjected to pressure rise by impeller 103, vortex turbulent noises caused when the sucked air passes through casing 105, and noises caused in casing 105 are emitted from suction port 106. Some of them are incident from inlet portion 115 having clearance distance i into resonant space 112. The incident sound waves of the noises at a frequency specified according to a volume and shape of resonant space 112 are resonated and suppressed in such a manner that air column resonance occurs in resonant space 112 and that inlet portion 115 and resonant space 112 function as a Helmholtz resonator.

The frequency of the noises that are resonated and suppressed in resonant space 112 is specified according to the volume and shape of resonant space 112. In such a centrifugal fan in the related art, a range in which the volume and shape of resonant space 112 can be adjusted is small. For this reason, a range of frequencies of noises that can be resonated and suppressed is small. The range of frequencies of noises that can be suppressed is therefore required to be increased.

To suppress noises at a low frequency, the volume of resonant space 112 needs to be increased. A size of outer casing 101 thus becomes larger. Noises at a lower frequency are required to be suppressed without changing the size of outer casing 101.

The volume of resonant space 112 cannot be easily changed. If main frequencies of noises are changed according to an installed state of the centrifugal fan or there are noises at a plurality of outstanding frequencies, a noise reduction effect by resonance noise-suppression may be reduced. Frequencies at which noises can be suppressed are required to be adjusted.

[Patent Document 1] Japanese Patent No. 3279834

DISCLOSURE OF THE INVENTION

The present invention addresses such problems in the related art and provides a centrifugal fan that can increase a range of frequencies of noises in which noises can be suppressed, can suppress noises at a lower frequency without changing a size of an outer casing, and can adjust frequencies of noises at which noises can be suppressed.

A centrifugal fan of the present invention has, in an outer casing having an opening, a motor that couples an impeller so as to rotate the impeller on a rotational axis, a casing that surrounds a periphery of the impeller and has a suction port, and a bell-mouthed orifice that has an opening communicating with the opening of the outer casing. In the centrifugal fan that resonates and suppresses noises released from the suction port by a resonant space formed by the orifice, part of a path where sound waves of noises incident from an inlet portion between an end of the orifice and the casing into the resonant space are reflected is made longer.

Noises at a lower frequency can be suppressed without increasing a volume of the resonant space. The centrifugal fan that can reduce noises at a desired frequency without increasing a size of the outer casing can be obtained.

A centrifugal fan of the present invention has, in an outer casing having an opening, a motor that couples an impeller so as to rotate the impeller on a rotational axis, a casing that surrounds a periphery of the impeller and has a suction port, and a bell-mouthed orifice that has an opening communicating with the opening of the outer casing. In the centrifugal fan, a member closing a clearance portion between an end of the orifice and the casing is a noise absorbing structural material, and a space formed by the orifice is a rear air layer, thereby forming a resonance type noise absorbing structure.

With this structure, the resonance type noise absorbing structure can be formed by the member closing the clearance portion and the space formed by the orifice. Hence, a range of frequencies of noises in which noises can be suppressed can be increased. Frequencies of noises at which noises can be suppressed can be adjusted.

REFERENCE MARKS IN THE DRAWINGS

Figure 1A:
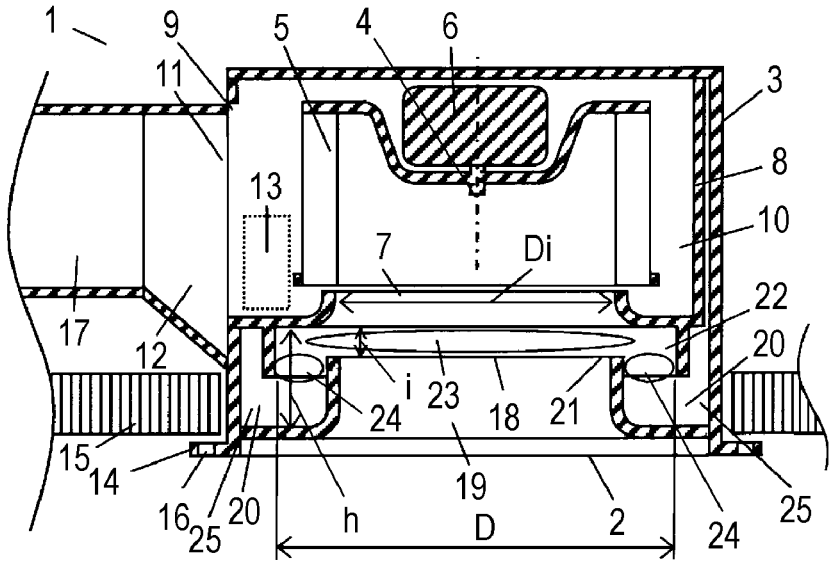
FIG. 1A is a side sectional view illustrating a centrifugal fan of Embodiment 1 of the present invention.

1 centrifugal fan
2 opening
3 outer casing
4 rotational axis
5 impeller
6 motor
7 suction port
8 side wall
9 discharge port
10 casing
11 discharge opening
12 discharge adapter
13 electric equipment portion
14 flange portion
15 ceiling material
16 hole
17 duct
18 opening
19 orifice
20 resonant space
21 end
22 wall body
23 inlet portion
24 inlet portion region
25 volume portion
26 throat portion
27 hollow portion
28 experimental object
30 circular pipe
31 noise receiving side circular pipe
32 transmission loss for each frequency in the absence of the wall body
33 transmission loss for each frequency in the presence of the wall body
34 end face of the wall body
35 screwed portion
36 screwing portion
37 screw
38 inside wall
39 outside wall
40 double pipe
41 partition wall
42 outer peripheral space
43 motor side outer wall
44 rear space
c sound speed
D inside diameter of the wall body
Di inside diameter of the suction port
F frequency
h clearance
i clearance distance
L throat portion length
La axial depth length
Lr diametrical depth length
S throat portion area
TL transmission loss
V hollow portion volume

PREFERRED EMBODIMENTS FOR CARRYING OUT OF THE INVENTION

The present invention includes, in an outer casing having an opening, a motor that couples an impeller so as to rotate the impeller on a rotational axis, a casing that surrounds a periphery of the impeller and has a suction port, and a bell-mouthed orifice that has an opening communicating with the opening of the outer casing. In the centrifugal fan that resonates and suppresses noises released from the suction port by a resonant space formed by the orifice, part of a path where sound waves of noises incident from an inlet portion between an end of the orifice and the casing into the resonant space are reflected is made longer. Since noises at a lower frequency can be suppressed without increasing a volume of the resonant space, noises at a desired frequency can be reduced without increasing a size of the outer casing. The present invention relates to a centrifugal fan in which the suction port of the casing is bell-mouthed. An inflow of air into the casing can be smoothened, ventilation efficiency can be improved without increasing a size of the outer casing, and noises can be reduced.

The present invention relates to a centrifugal fan in which the casing has a scroll shape. A dynamic pressure of air flowed out from the impeller can be efficiently converted to a static pressure. The air can be discharged from a discharge port. Ventilation efficiency can thus be improved without increasing a size of the outer casing, and noises can be reduced.

The present invention relates to a centrifugal fan in which the opening of the orifice is concentric with the suction port of the casing. Noises from the suction port of the casing can be smoothly guided to the entire resonant space, and sucked air can be smoothly guided to the casing. Noises at a desired frequency can thus be reduced without increasing a size of the outer casing.

The present invention relates to a centrifugal fan in which the opening of the orifice has a diameter equal to or smaller than that of the suction port. Noises from the suction port of the casing can be efficiently guided to the resonant space. Noises at a desired frequency can thus be reduced without increasing a size of the outer casing.

The present invention relates to a centrifugal fan in which a path where some of sound waves of noises incident from the inlet portion of the resonant space are reflected in the rearmost portion of the resonant space is made longer. Noises at a lower frequency can be suppressed without increasing a volume of the resonant space. Noises at a desired frequency can thus be reduced without increasing a size of the outer casing.

The present invention relates to a centrifugal fan in which a wall body is provided in the resonant space and part of the path where sound waves of noises are reflected is made longer. Sound waves of noises are propagated so as to move around the wall body. The path where some of sound waves of noises are reflected can be made longer. Noises at a lower frequency can also be suppressed without increasing a volume of the resonant space. Hence, noises at a desired frequency can be reduced without increasing a size of the outer casing.

The present invention relates to a centrifugal fan in which the wall body provided in the resonant space has a cylindrical pipe shape that is concentric with the suction port and has one end contacting the casing. A path where sound waves of noises emitted from the suction port move around the wall body has only one U-shaped curve. Sound waves of noises can be smoothly propagated to the rearmost portion of the path where sound waves of noises are reflected, and noises at a lower frequency can be suppressed without increasing a volume of the resonant space. Hence, noises at a desired frequency can be reduced without increasing a size of the outer casing.

The present invention relates to a centrifugal fan in which inside diameter D of the cylindrical pipe shaped wall body that is provided in the resonant space and is concentric with the suction port establishes a relation of $D>Di+2i$ between inside diameter Di of the suction port and clearance distance i of the inlet portion. The inlet portion and the wall body can be sufficiently separated, and reduction of an amount of sound waves of noises that are incident into the resonant space through reflection of some of sound waves of noises attempting to be incident into the resonant space near the inlet portion by the wall body can be prevented. Hence, noises at a lower frequency can be suppressed without reducing the amount of sound waves that are resonated and suppressed.

The present invention relates to a centrifugal fan in which inside diameter D of the cylindrical pipe shaped wall body that is provided in the resonant space and is concentric with the suction port establishes a relation of $D<Di+2i$ between inside diameter Di of the suction port and clearance distance i of the inlet portion. An area of an inlet portion region that is surrounded by the cylindrical pipe shaped wall body and the orifice and is equivalent to a throat portion area of a Helmholtz resonator can be reduced. A volume of a portion of the resonant space that locates at a rear side of the cylindrical pipe shaped wall body and is equivalent to a hollow portion volume can be increased. Hence, by an operation of the Helmholtz resonator, noises at a lower frequency can be suppressed.

The present invention relates to a centrifugal fan in which a thickness of the wall body and the end of the orifice is increased so that the cylindrical pipe shaped wall body that is provided in the resonant space and is concentric with the suction port and the end of the orifice are overlapped in a diametrical direction. A diametrical depth length of the inlet portion region that is surrounded by an upper end of the cylindrical pipe shaped wall body and the end of the orifice and is equivalent to a throat portion length of the Helmholtz resonator can be made longer. Hence, by the operation of the Helmholtz resonator, noises at a lower frequency can be suppressed.

The present invention relates to a centrifugal fan in which inside diameter D of the cylindrical pipe shaped wall body is not uniform in a circumferential direction. A portion in which a length of a path where sound waves of noises emitted from the suction port are reflected is different can be provided. Sound waves of noises at a plurality of frequencies can be resonated and suppressed in the resonant space. Noises at a plurality of low frequencies can be suppressed without increasing a volume of the resonant space. Noises at a desired frequency can also be reduced without increasing a size of the outer casing.

The present invention relates to a centrifugal fan in which a height of the cylindrical pipe shaped wall body is not uniform in a circumferential direction. A portion in which a length of a path where sound waves of noises emitted from the suction port are reflected is different can be provided, and a portion in which an axial depth length of the inlet portion region that is surrounded by the upper end of the cylindrical pipe shaped wall body and the end of the orifice and is equivalent to the throat portion length of the Helmholtz resonator is different can be provided. Hence, sound waves of noises at a plurality of frequencies can be resonated and suppressed in the resonant space, noises at a plurality of low frequencies can be suppressed without increasing a volume of the resonant space, and noises at a desired frequency can be reduced without increasing a size of the outer casing.

The present invention relates to a centrifugal fan in which clearance distance i of the inlet portion into the resonant space is not uniform in a circumferential direction. A portion in which the axial depth length of the inlet portion region that is surrounded by the upper end of the cylindrical pipe shaped wall body and the end of the orifice and is equivalent to the throat portion length of the Helmholtz resonator is different in a circumferential direction. Hence, by the operation of the Helmholtz resonator, sound waves of noises at a plurality of frequencies can be resonated and suppressed in the resonant space.

The present invention relates to a centrifugal fan in which inside diameter D of the cylindrical pipe shaped wall body that is provided in the resonant space and is concentric with the suction port can be adjusted. Even if frequencies of noises emitted from the suction port are changed according to an installed state of the centrifugal fan or the like, the frequencies at which noises are suppressed can be adjusted by changing inside diameter D of the cylindrical pipe shaped wall body. Noises at a lower frequency can be suppressed without increasing a volume of the resonant space. Hence, noises at a desired frequency can be reduced without increasing a size of the outer casing.

The present invention relates to a centrifugal fan in which a height of the cylindrical pipe shaped wall body that is provided in the resonant space and is concentric with the suction port can be adjusted. Even if frequencies of noises emitted from the suction port are changed according to an operation state of the centrifugal fan or the like, the frequencies at which noises are suppressed can be adjusted by changing the height of the cylindrical pipe shaped wall body. Noises at a lower frequency can be suppressed without increasing a volume of the resonant space. Hence, noises at a desired frequency can be reduced without increasing a size of the outer casing.

The present invention relates to a centrifugal fan in which at least one cylindrical pipe shaped wall body that is concentric with the suction port of the casing and has one end contacting the casing and at least one cylindrical pipe shaped wall body that is concentric with the suction port of the casing and has one end contacting the orifice are arranged alternately in a diametrical direction. The centrifugal fan can have a labyrinth structure in which sound waves of noises are propagated so as to alternately move around the wall bodies. A path where some of sound waves of noises are reflected can be made longer. Noises at a lower frequency can be suppressed without increasing a volume of the resonant space. Hence, noises at a desired frequency can be reduced without increasing a size of the outer casing.

The present invention relates to a centrifugal fan in which the cylindrical pipe shaped wall body that is provided in the resonant space and is concentric with the suction port is molded integrally with the casing. The cylindrical pipe shaped wall body that is concentric with the suction port and the casing can be made into one component. Hence, the number of components can be reduced, a production cost can be reduced, and noises at a desired frequency can be reduced without increasing a size of the outer casing.

The present invention relates to a centrifugal fan provided with a partition wall that divides the resonant space into a plurality of parts. Since sound waves of noises emitted from the suction port are resonated and suppressed in the resonant spaces having a plurality of volumes, noises at a plurality of low frequencies can be suppressed without increasing a volume of the resonant space. Hence, noises at a desired frequency can be reduced without increasing a size of the outer casing.

The present invention relates to a centrifugal fan in which the wall body having a different shape is provided in each of a plurality of resonant spaces and part of a path where sound waves of noises are reflected in each of the resonant spaces is made longer. Part of the path where sound waves of noises are propagated in the resonant spaces having a plurality of volumes can be made longer, and noises at a plurality of lower frequencies can be suppressed without increasing a volume of the resonant space. Hence, noises at a desired frequency can be reduced without increasing a size of the outer casing.

The present invention relates to a centrifugal fan in which clearance distances i of the inlet portions of the plurality of resonant spaces are different. A length of the inlet portion region that is surrounded by the cylindrical pipe shaped wall body and the end of the orifice and is equivalent to the throat portion length of the Helmholtz resonator can be set in each of the plurality of resonant spaces. By the operation of the Helmholtz resonator, noises at a plurality of lower frequencies can be suppressed without increasing a volume of the resonant space. Hence, noises at a desired frequency can be reduced without increasing a size of the outer casing.

The present invention relates to a centrifugal fan in which an outer peripheral space surrounded by a side wall of the casing and the outer casing is used as the resonant space. A volume of the resonant space can be increased, a path from the inlet portion to the rearmost portion can be made longer, and noises at a lower frequency can be suppressed. Hence, noises at a desired frequency can be reduced without increasing a size of the outer casing.

The present invention relates to a centrifugal fan in which a rear space between a motor side outer wall of the casing and the outer casing is used as the resonant space. A volume of the resonant space can be increased, a path from the inlet portion to the rearmost portion can be made longer, and noises at a lower frequency can be suppressed. Hence, noises at a desired frequency can be reduced without increasing a size of the outer casing.

The present invention relates to a centrifugal fan that includes, in an outer casing having an opening, a motor that couples an impeller so as to rotate the impeller on a rotational axis, a casing that surrounds a periphery of the impeller and has a suction port, and a bell-mouthed orifice that has an opening communicating with the opening of the outer casing, wherein a member closing a clearance portion between an end of the orifice and the casing is a noise absorbing structural material, and a space formed by the orifice is a rear air layer, thereby forming a resonance type noise absorbing structure. The resonance type noise absorbing structure can be formed by the member closing the clearance portion and the orifice. Hence, a range of frequencies in which noises can be suppressed can be increased.

The present invention relates to a centrifugal fan in which the suction port of the casing is bell-mouthed. An inflow of air into the casing can be smoothened, ventilation efficiency can be improved without increasing a size of the outer casing, and noises can be reduced.

The present invention relates to a centrifugal fan in which the casing has a scroll shape. A dynamic pressure of air flowed out from the impeller can be efficiently converted to a static pressure. The air can be discharged from a discharge port. Hence, ventilation efficiency can be improved without increasing a size of the outer casing, and noises can be reduced.

The present invention relates to a centrifugal fan in which the opening of the orifice is concentric with the suction port of the casing. Noises from the suction port of the casing can be smoothly guided to the entire resonant space, and sucked air can be smoothly guided to the casing. Hence, noises at a desired frequency can be reduced without increasing a size of the outer casing.

The present invention relates to a centrifugal fan in which the opening of the orifice has a diameter equal to or smaller than that of the suction port. Noises from the suction port of the casing can be efficiently guided to the resonant space. Hence, noises at a desired frequency can be reduced without increasing a size of the outer casing.

The present invention relates to a centrifugal fan in which the member closing the clearance portion is a filmy material. There is formed a vibration system in which the filmy material is a mass and the space as the rear air layer is a spring, so that a filmy noise absorbing structure as the resonance type noise absorbing structure can be formed. Hence, a range of frequencies in which noises can be suppressed can be increased.

The present invention relates to a centrifugal fan in which the member closing the clearance portion is a holed plate. There is formed a vibration system in which air in a hole portion of the holed plate is a mass and the rear air layer is a spring, so that a holed plate noise absorbing structure as the resonance type noise absorbing structure that absorbs noises according to the same principle as the Helmholtz resonator can be formed. Hence, a range of frequencies of noises in which noises can be suppressed can be increased.

The present invention relates to a centrifugal fan in which the member closing the clearance portion is a porous material. Noises at a relatively high frequency can be absorbed by the porous material itself. In addition, there is formed a vibration system in which the porous material is a mass and the rear air layer is a spring, so that a porous noise absorbing structure as the resonance type noise absorbing structure can be formed. Hence, noises at a relatively low frequency can be suppressed, and a range of frequencies of noises in which noises can be suppressed can be increased.

The present invention relates to a centrifugal fan in which a wall body is provided in the space and a thickness of the rear air layer is increased. A length of a path where sound waves of noises are propagated so as to move around the wall body in the space can be regarded as a thickness of the rear air layer in the resonance type noise absorbing structure. Hence, the thickness of the rear air layer can be increased, and noises at a lower frequency can be suppressed without changing a size of the outer casing.

The present invention relates to a centrifugal fan in which the wall body provided in the space has a cylindrical pipe shape that is concentric with the suction port and has one end contacting the casing. A path where sound waves of noises move around the wall body in the space has only one U-shaped curve. Sound waves of noises can thus be smoothly propagated. Hence, a thickness of the rear air layer can be increased more stably, and noises at a lower frequency can be suppressed without changing a size of the outer casing by the wall body of a simple structure.

The present invention relates to a centrifugal fan in which inside diameter D of the cylindrical pipe shaped wall body that is provided in the space and is concentric with the suction port is not uniform in a circumferential direction. As inside diameter D of the cylindrical pipe shaped wall body is partially different, a portion in which a thickness of the rear air layer is different can be provided. Hence, noises at a plurality of frequencies can be suppressed, and a range of frequencies of noises in which noises can be suppressed can be increased.

The present invention relates to a centrifugal fan in which a height of the cylindrical pipe shaped wall body that is provided in the space and is concentric with the suction port is not uniform in a circumferential direction. As the height of the cylindrical pipe shaped wall body is partially different, a portion in which a thickness of the rear air layer is different can be provided. Hence, noises at a plurality of frequencies can be suppressed, and a range of frequencies of noises in which noises can be suppressed can be increased.

The present invention relates to a centrifugal fan in which an inside diameter of the cylindrical pipe shaped wall body that is provided in the space and is concentric with the suction port can be adjusted. A thickness of the rear air layer can be adjusted by adjusting the inside diameter of the cylindrical pipe shaped wall body. Hence, frequencies of noises at which noises can be suppressed can be adjusted.

The present invention relates to a centrifugal fan in which a height of the cylindrical pipe shaped wall body that is provided in the space and is concentric with the suction port can be adjusted. A thickness of the rear air layer can be adjusted by adjusting the height of the cylindrical pipe shaped wall body. Hence, frequencies of noises at which noises can be suppressed can be adjusted.

The present invention relates to a centrifugal fan in which at least one cylindrical pipe shaped wall body that is concentric with the suction port of the casing and has one end contacting the casing and at least one cylindrical pipe shaped wall body that is concentric with the suction port of the casing and has one end contacting the orifice are arranged alternately in a diametrical direction. The centrifugal fan can have a labyrinth structure in which sound waves of noises are propagated in the space so as to alternately move around the wall bodies, a thickness of the rear air layer can be increased, and noises at a lower frequency can be suppressed without changing a size of the outer casing.

The present invention relates to a centrifugal fan provided with a partition wall that divides the space formed by the orifice into a plurality of parts. A plurality of resonance type noise absorbing structures in which a shape and volume of the space are different can be formed. Hence, noises at a plurality of frequencies can be suppressed, and a range of frequencies of noises in which noises can be suppressed can be increased.

The present invention relates to a centrifugal fan in which a member closing the clearance portion is provided in each of a plurality of spaces divided by the partition wall and at least two kinds of members are applied. A plurality of kinds of resonance type noise absorbing structures can be formed. Hence, noises at a plurality of frequencies can be suppressed, and a range of frequencies of noises in which noises can be suppressed can be increased.

The present invention relates to a centrifugal fan in which the wall body having a different shape is provided in each of a plurality of spaces divided by the partition wall and a thickness of the rear air layer is increased in each of the spaces. The resonance type noise absorbing structure in which the thickness of the rear air layer is different in each of the divided spaces can be formed. Hence, noises at a plurality of frequencies can be suppressed, and a range of frequencies of noises in which noises can be suppressed can be increased.

The present invention relates to a centrifugal fan in which an outer peripheral space surrounded by a side wall of the casing and the outer casing is used as the rear air layer. The outer peripheral space can be used as the rear air layer of the resonance type noise absorbing structure. Hence, a thickness of the rear air layer can be increased, and noises at a lower frequency can be suppressed without changing a size of the outer casing.

The present invention relates to a centrifugal fan in which a rear space between a motor side outer wall of the casing and the outer casing is used as the rear air layer. The rear space can be used as the rear air layer of the resonance type noise absorbing structure. Hence, a thickness of the rear air layer can be increased, and noises at a lower frequency can be suppressed without changing a size of the outer casing.

Embodiments of the present invention will be described below with reference to the drawings.

Embodiment 1

Figure 1B:
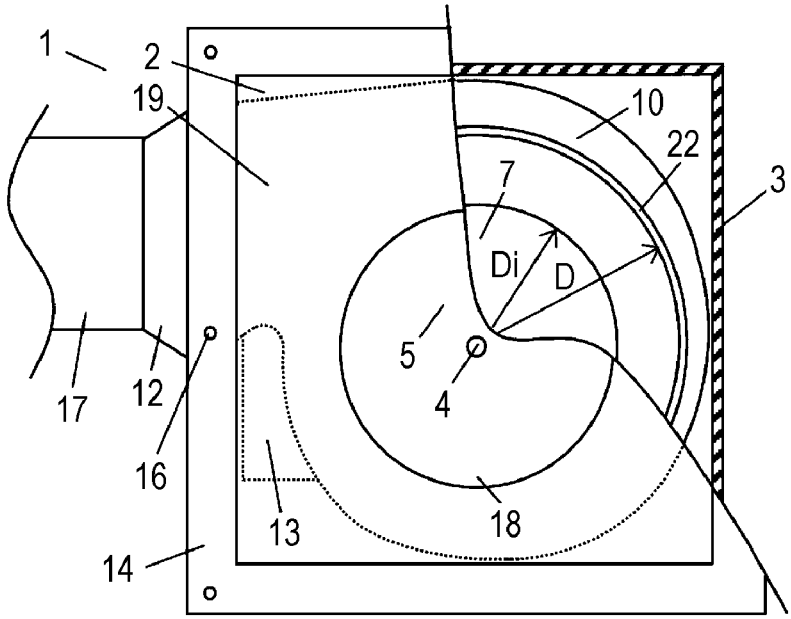
FIG. 1B is a surface portion sectional view illustrating the centrifugal fan of Embodiment 1 of the present invention.

As illustrated in FIGS. 1A and 1B, centrifugal fan 1 used as a ceiling burying type ventilating fan includes, in outer casing 3 having an inner dimension of 265 mm square, a height of 195 mm, and opening 2 in a lower surface, motor 6 that couples multiblade impeller 5 having a diameter of 180 mm so as to rotate impeller 5 on rotational axis 4, and casing 10 that surrounds a periphery of impeller 5 and has suction port 7 that is bell-mouthed and has inside diameter Di of 150 mm in a lower surface and discharge port 9 on side wall 8. Side wall 8 of casing 10 has a scroll shape in which an air path is gradually expanded toward discharge port 9. Discharge port 9 of casing 10 communicates with discharge adapter 12 via discharge opening 11 provided in one side of outer casing 3. Electric equipment portion 13 that houses an electric component such as a connector or a terminal for electrically connecting motor 6 with an external power supply is arranged in a portion between casing 10 and outer casing 3. Flange portion 14 is provided on an outer periphery of the lower surface of outer casing 3. Outer casing 3 is fixed to ceiling material 15 by a screw and the like through hole 16 provided in flange portion 14. Duct 17 that is disposed on a ceiling and communicates with outdoors is joined to discharge port 9 via discharge adapter 12.

Orifice 19 has bell-mouthed opening 18 that is concentric with suction port 7 of casing 10 and has an inside diameter of 148 mm equal to or smaller than that of suction port 7. Orifice 19 is separated from suction port 7 of casing 10 by predetermined clearance h (60 mm) and closes opening 2 of outer casing 3. Orifice 19 forms resonant space 20 between casing 10 and orifice 19. End 21 of orifice 19 is separated from the lower surface of casing 10 by clearance distance i (20 mm). Cylindrical pipe shaped wall body 22 that is concentric with suction port 7 of casing 10 is provided integrally with the lower surface of casing 10. Cylindrical pipe shaped wall body 22 has a thickness of 2 mm and a height of 28 mm. Inside diameter D of the wall body is 216 mm and establishes a relation of D>Di+2i between inside diameter Di (150 mm) of the suction port of casing 10 and clearance distance i (20 mm) between end 21 of orifice 19 and the casing.

In the above configuration, when impeller 5 is rotated by motor 6, sucked air passes from opening 2 through opening 18 of orifice 19. The sucked air smoothly enters impeller 5 from bell-mouthed suction port 7 of casing 10. The sucked air is subjected to pressure rise by impeller 5. The sucked air passes through an inside of casing 10 in a scroll shape. A dynamic pressure is thereby efficiently converted to a static pressure. The sucked air is discharged to duct 17 by discharge adapter 12 and is then discharged to outdoors. Opening 18 of orifice 19 has a diameter equal to or smaller than inside diameter Di of the suction port of casing 10, has a sufficiently large area, and has a bell mouth shape smoothly introducing the sucked air. Thus, lowering of an aerodynamic performance of centrifugal fan 1 due to pressure loss can be prevented.

Sound waves of rotational noises caused when the sucked air is subjected to pressure rise by impeller 5, vortex turbulent noises caused when the sucked air passes through the inside of casing 10, and noises amplified by resonance in casing 10 are emitted downward from suction port 7. Some of the sound waves of the noises emitted from suction port 7 of casing 10 are incident from inlet portion 23 configured between end 21 of orifice 19 and casing 10 into resonant space 20. Suction port 7 of casing 10 and resonant space 20 communicate with each other via inlet portion 23. Opening 18 of orifice 19 is concentric with suction port 7 of casing 10. The diameter of opening 18 of orifice 19 is equal to or smaller than inside diameter Di of the suction port of casing 10. Hence, some of the sound waves of the noises emitted from suction port 7 of casing 10 are easily incident from inlet portion 23 configured between end 21 of orifice 19 and casing 10 into resonant space 20.

Of the sound waves of the noises incident from inlet portion 23 into resonant space 20, some of the sound waves of the noises at a frequency specified according to a volume and shape of the resonant space 20 are resonated and suppressed in such a manner that air column resonance occurs in resonant space 20 and that inlet portion region 24 surrounded by cylindrical pipe shaped wall body 22 and orifice 19 and volume portion 25 of resonant space 20 that locates at a rear side of cylindrical pipe shaped wall body 22 function as a Helmholtz resonator.

Since the frequencies of the noises suppressed by air column resonance depend on a length of a path to a structure (here, casing 10 and outer casing 3) where sound waves incident from inlet portion 23 are reflected, the frequencies are lowered as the length of the path is longer.

Figure 2:
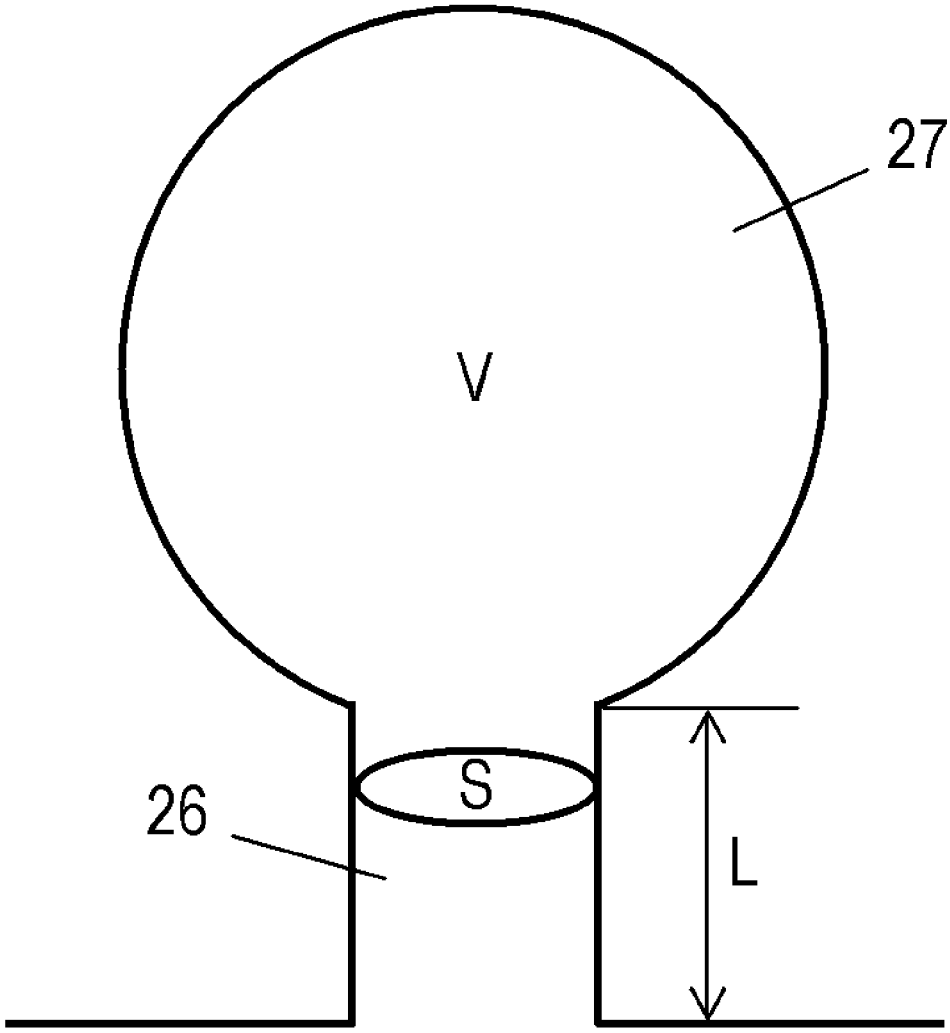
FIG. 2 is a diagram illustrating a principle of a Helmholtz resonator.

Frequency F at which noises are suppressed by the operation of the Helmholtz resonator is expressed by FIG. 2 and the following equation (1) where c is the speed of sound, S is a throat portion area, L is a throat portion length, and V is a hollow portion volume.

$$F = \frac{c}{2\pi}\sqrt{\frac{S}{L \times V}} \qquad \text{Equation (1)}$$

In centrifugal fan 1 of the configuration of Embodiment 1, inlet portion region 24 surrounded by cylindrical pipe shaped wall body 22 and orifice 19 of FIGS. 1A and 1B is equivalent to throat portion 26 of FIG. 2. Likewise, volume portion 25 of resonant space 20 that locates at the rear side of cylindrical pipe shaped wall body 22 is equivalent to hollow portion 27.

Since cylindrical pipe shaped wall body 22 is located in resonant space 20, sound waves of noises are propagated so as to move around wall body 22, and part of a path where sound waves of noises incident into resonant space 20 are reflected can be made longer. Hence, frequencies of noises to be resonated and suppressed can be lowered. In the structure (here, casing 10 and outer casing 3) in which sound waves incident from inlet portion 23 are reflected, the path to the rearmost portion in which the path of the sound waves from inlet portion 23 is longest can be made longer. Noises at a lower frequency can thus be resonated and suppressed.

Part of the path where sound waves of noises incident into resonant space 20 are reflected is made longer. This means that, for example, wall body 22 is provided as in this example so that some of sound waves move around wall body 22. As compared with a case of the absence of wall body 22, part of the path where sound waves are reflected is made longer. For example, some of sound waves may be moved around wall body 22, as such an example, a structure as means for causing some of sound waves to move around wall body 22 can be provided in resonant space 20.

Wall body 22 has a cylindrical pipe shape concentric with suction port 7 of casing 10 and has one end contacting the lower surface of casing 10. The path where sound waves of noises emitted from suction port 7 are incident from inlet portion 23 into resonant space 20 and move around wall body 22 has only one U-shaped curve. Hence, sound waves of noises can be smoothly propagated to the rearmost portion of the path where sound waves of noises are reflected. Consequently, the path where some of sound waves of noises incident from inlet portion 23 of resonant space 20 are reflected in the rearmost portion of resonant space 20 is made longer. Noises at a lower frequency can thus be suppressed without increasing a volume of the resonant space. The centrifugal fan in which noises at a desired frequency can be reduced without increasing a size of the outer casing can be obtained. The rearmost portion refers to the rearmost portion of resonant space 20, that is, the furthest position, seen from inlet portion 23 of resonant space 20.

Between inside diameter Di of the suction port and clearance distance i of inlet portion 23, a relation of D>Di+2i is established. Inlet portion 23 and wall body 22 can be sufficiently separated. Consequently, reduction of an amount of sound waves of noises incident into resonant space 20 by reflection of some of sound waves of noises attempting to be incident into resonant space 20 near inlet portion 23 by wall body 22 can be prevented, and reduction of the amount of sound waves that are resonated and suppressed can be prevented.

As described above, since noises at a lower frequency can be suppressed without increasing the volume of resonant space 20, noises at a desired frequency can be reduced without increasing the size of outer casing 3.

Wall body 22 and casing 10 can be made into one component. Thus, the number of components can be reduced, and a production cost can be reduced.

Figure 3A:
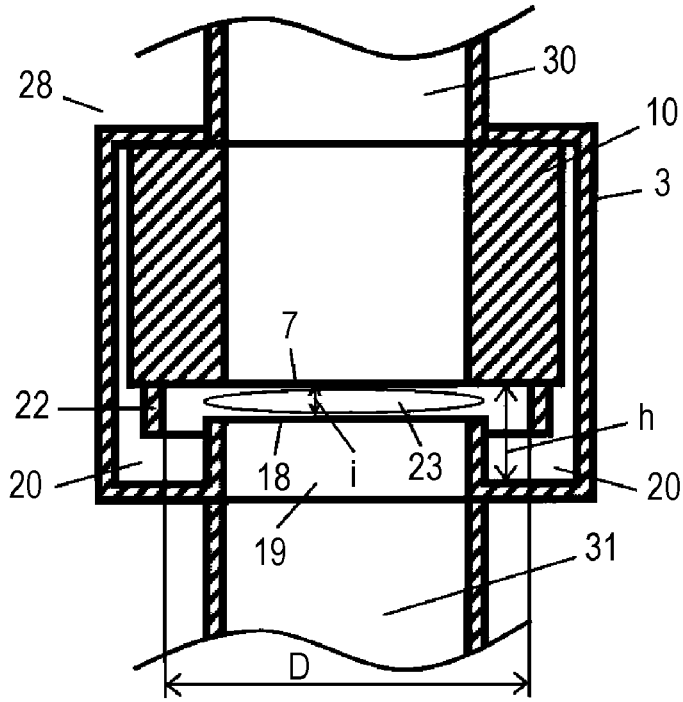
FIG. 3A is a side sectional view illustrating an experimental object of an experiment to observe a noise-suppression effect of the centrifugal fan of Embodiment 1 of the present invention.
Figure 3B:
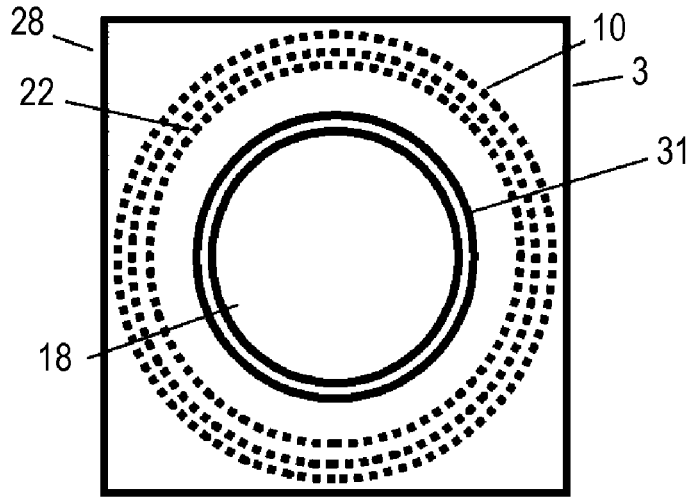
FIG. 3B is a lower surface view illustrating the experimental object of the experiment to observe the noise-suppression effect of the centrifugal fan of Embodiment 1 of the present invention.
Figure 4:
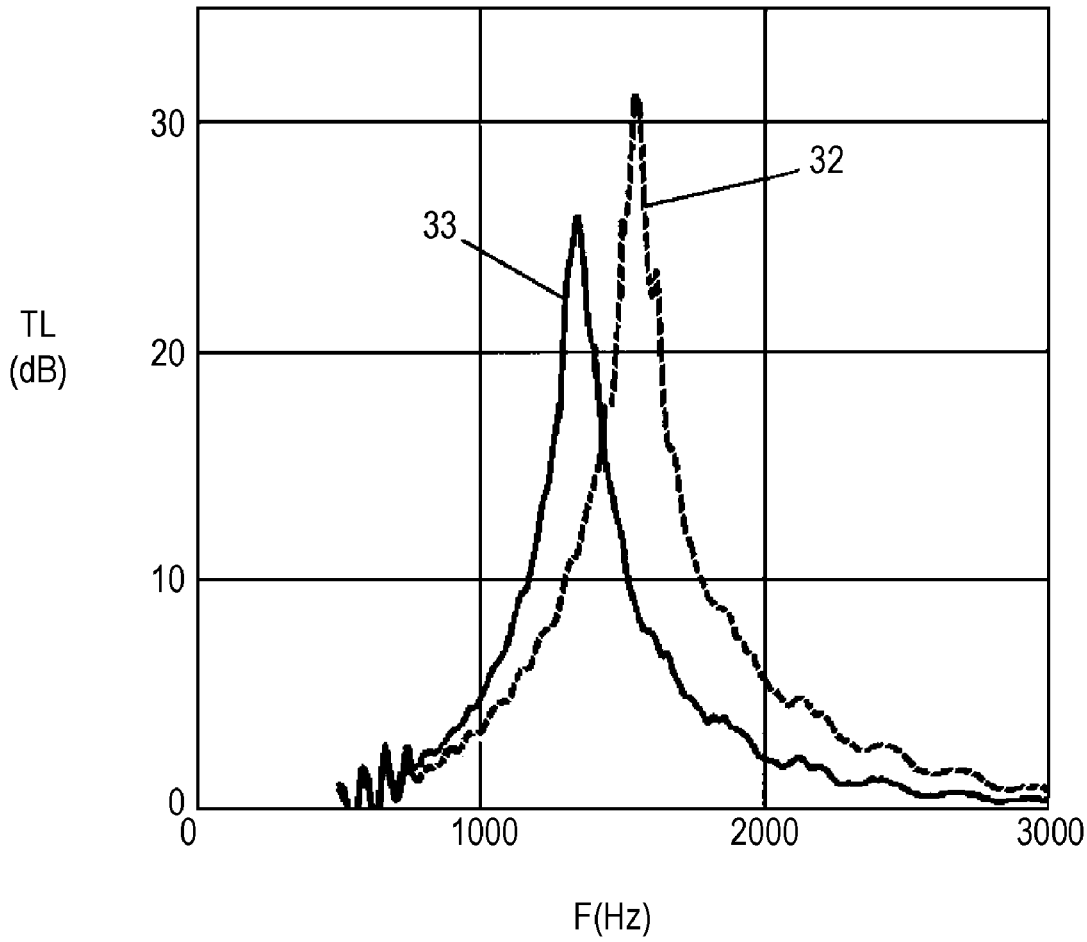
FIG. 4 is a diagram illustrating the noise-suppression effect of the centrifugal fan of Embodiment 1 of the present invention.

FIGS. 3A, 3B, and 4 illustrate descriptions and graphs of experimental object 28 when noise suppression in resonant space 20 is experimentally observed. In the experiment, for improving efficiency, a size of experimental object 28 equivalent to centrifugal fan 1 is a quarter of centrifugal fan 1, and for simplification, casing 10 has a cylindrical pipe shape. Distance h between casing 10 and orifice 19 is equivalent to 60 mm in centrifugal fan 1. Clearance distance i of inlet portion 23 is equivalent to 20 mm. Inside diameter D of cylindrical pipe shaped wall body 22 is equivalent to 216 mm, and a height thereof is equivalent to 28 mm.

An amount in which sound waves emitted from circular pipe 30 equivalent to suction port 7 of casing 10 are transmitted to noise receiving side circular pipe 31 is measured to measure an amount of resonant noise-suppression in resonant space 20, that is, transmission loss TL.

In the graph of FIG. 4, a horizontal axis indicates frequency F of a sound wave and a vertical axis indicates transmission loss TL as a noise reduction effect. The dotted line in the graph of FIG. 4 indicates transmission loss 32 for each frequency in the absence of the wall body, and the solid line indicates transmission loss 33 for each frequency in the presence of the wall body. In the presence of wall body 22, frequency F at which transmission loss TL is maximal is found to be reduced.

Cylindrical pipe shaped wall body 22 may have a shape that can increase part of the path of sound waves of noises incident into resonant space 20 and can bend the path in a U-shape on a cross section passing through rotational axis 4. Accordingly, cylindrical pipe shaped wall body 22 may have a polygonal pipe shape or an oval pipe shape. Even if cylindrical pipe shaped wall body 22 is not concentric with suction port 7 of casing 10, a similar effect can be obtained.

In this configuration, resonant space 20 formed by orifice 19 is formed so as to be surrounded by orifice 19, casing 10, and outer casing 3, but resonant space 20 may be surrounded by other structures of products equipped with orifice 19 and centrifugal fan 1, e.g., a filter, a heater, an electric component, and a case of an electric component. A similar effect can be obtained by a configuration in which air column resonance occurs in resonant space 20, or in which inlet portion region 24 surrounded by cylindrical pipe shaped wall body 22 and orifice 19 and volume portion 25 of resonant space 20 that locates at the rear side of cylindrical pipe shaped wall body 22 function as the Helmholtz resonator for resonance noise suppression.

Centrifugal fan 1 may be horizontally installed on a wall, not on a ceiling. In this case also, a similar effect can be obtained.

Embodiment 2

Embodiment 2 of the present invention will be described next. Description of similar parts to those in Embodiment 1 of the present invention is not given, and only the parts that are unique to Embodiment 2 will be described.

Figure 5:
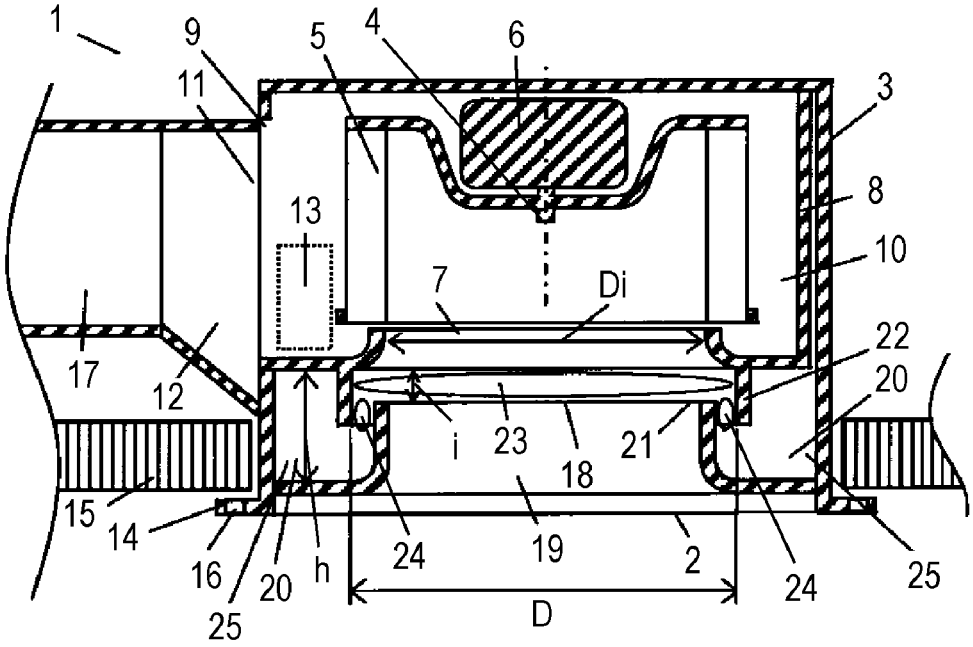
FIG. 5 is a side sectional view illustrating a centrifugal fan of Embodiment 2 of the present invention.

In Embodiment 2, as illustrated in FIG. 5, inside diameter D of the cylindrical pipe shaped wall body that is provided in resonant space 20 and is concentric with suction port 7 is 160 mm, and between inside diameter Di (150 mm) of suction port 7 and clearance distance i (20 mm) of inlet portion 23, a relation of D<Di+2i is established.

By this configuration, an area of inlet portion region 24 that is surrounded by cylindrical pipe shaped wall body 22 and orifice 19 and is equivalent to throat portion area S of a Helmholtz resonator can be reduced. A volume of resonant space 20 that locates at a rear side of cylindrical pipe shaped wall body 22 and is equivalent to hollow portion volume V can be increased. Hence, by an operation of the Helmholtz resonator, noises at a lower frequency can be suppressed.

Embodiment 3

Embodiment 3 of the present invention will be described next. Description of similar parts to those of Embodiment 1 of the present invention is not given and only the parts that are unique to Embodiment 3 will be described.

Figure 6:
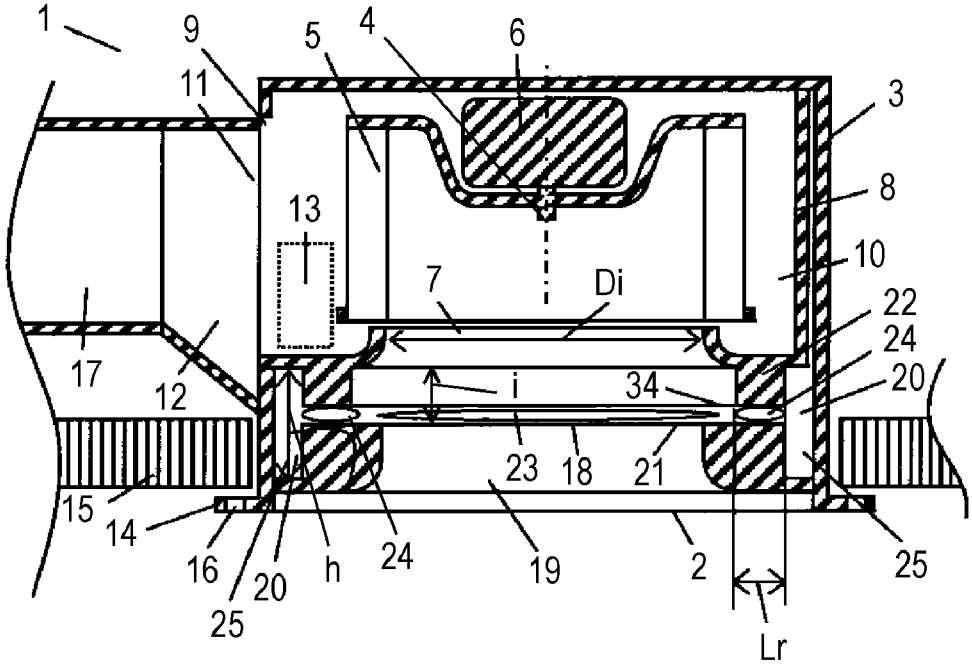
FIG. 6 is a side sectional view illustrating a centrifugal fan of Embodiment 3 of the present invention.

In Embodiment 3, as illustrated in FIG. 6, end 21 of orifice 19 is arranged such that cylindrical pipe shaped wall body 22 that is provided in resonant space 20 and is concentric with suction port 7 has a thickness of 20 mm and faces end face 34 of the wall body with a clearance of 5 mm. A region sandwiched between end face 34 of the wall body and end 21 of orifice 19 configures inlet portion region 24.

By this configuration, diametrical depth length Lr of inlet portion region 24 that is surrounded by end face 34 of the cylindrical pipe shaped wall body and end 21 of orifice 19 and is equivalent to throat portion length L of a Helmholtz resonator can be increased. Hence, by an operation of the Helmholtz resonator, noises at a lower frequency can be suppressed.

End 21 of orifice 19 and end face 34 of the wall body have only to be longer in a diametrical direction and only the end face may be thickened. A similar effect can also be obtained from the configuration.

Embodiment 4

Embodiment 4 of the present invention will be described next. Description of similar parts to those of Embodiment 1 of the present invention is not given, and only the parts that are unique to Embodiment 4 will be described.

Figure 7:
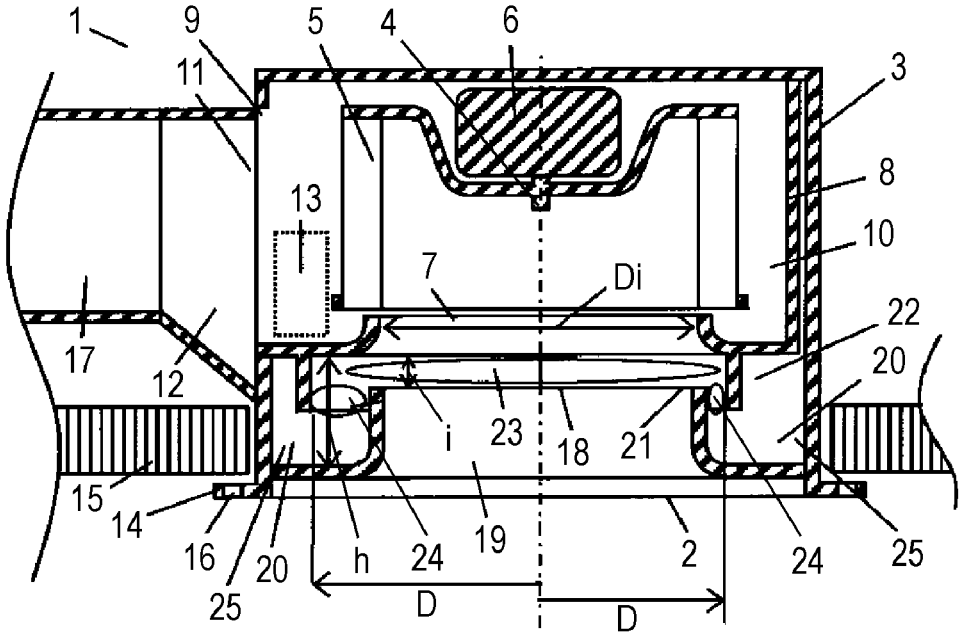
FIG. 7 is a side sectional view illustrating a centrifugal fan of Embodiment 4 of the present invention.

In Embodiment 4, as illustrated in FIG. 7, inside diameter D of the cylindrical pipe shaped wall body is not uniform in a circumferential direction such that one portion thereof is 216 mm and the other portion thereof is 160 mm.

By this configuration, inside diameter D of the cylindrical pipe shaped wall body is partially different. A portion in which a length of a path where sound waves of noises emitted from suction port 7 are reflected is different can thus be provided. Hence, sound waves of noises at a plurality of frequencies can be resonated and suppressed in resonant space 20.

Embodiment 5

Embodiment 5 of the present invention will be described. Description of similar parts to those of Embodiment 1 of the present invention is not given, and only the parts that are unique to Embodiment 5 will be described.

Figure 8:
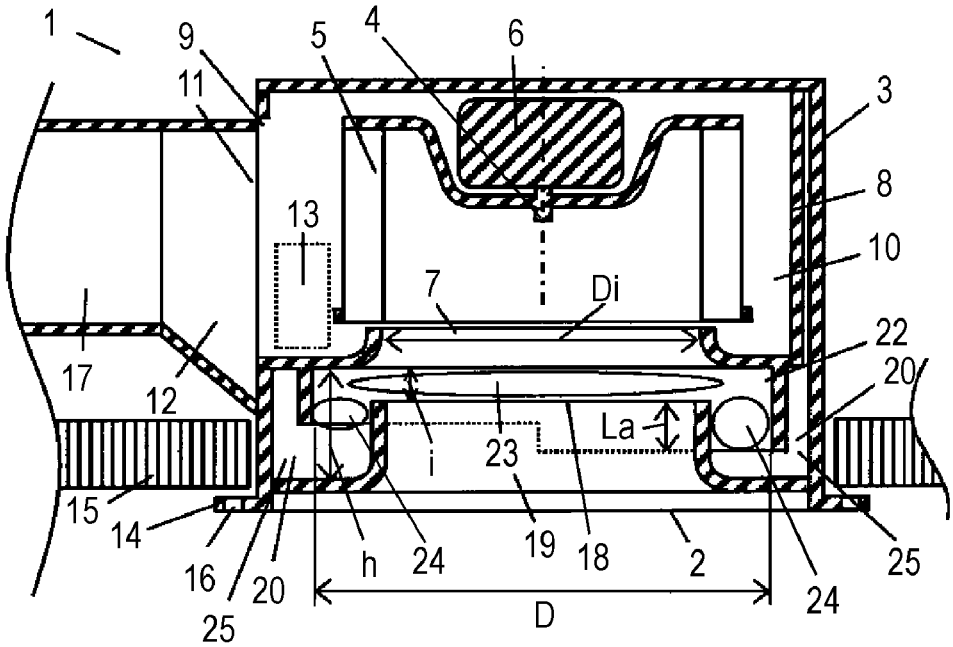
FIG. 8 is a side sectional view illustrating a centrifugal fan of Embodiment 5 of the present invention.

In Embodiment 5, as illustrated in FIG. 8, a height of cylindrical pipe shaped wall body 22 is not uniform in a circumferential direction such that one portion thereof is 28 mm and the other portion thereof is 40 mm.

By this configuration, the height of cylindrical pipe shaped wall body 22 is partially different. A portion in which a length of a path where sound waves of noises emitted from suction port 7 are reflected is different can be provided. A portion in which axial depth length La of inlet portion region 24 that is surrounded by cylindrical pipe shaped wall body 22 and orifice 19 and is equivalent to throat portion length L of a Helmholtz resonator can be provided. Hence, sound waves of noises at a plurality of frequencies can be resonated and suppressed in resonant space 20.

Embodiment 6

Embodiment 6 of the present invention will be described next. Description of similar parts to those of Embodiment 1 of the present invention is not given, and only the parts that are unique to Embodiment 6 will be described.

Figure 9:
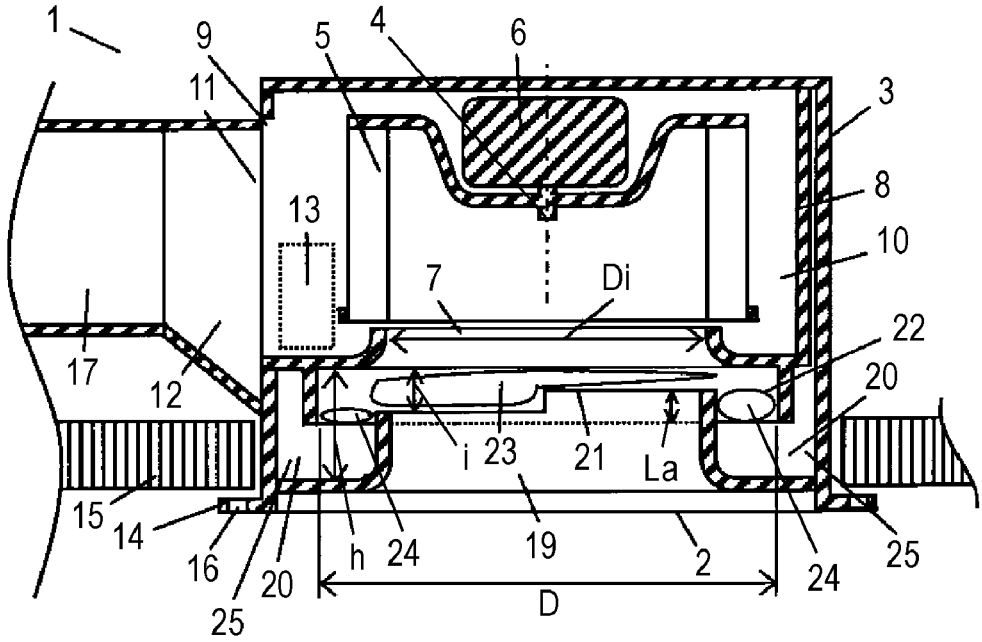
FIG. 9 is a side sectional view illustrating a centrifugal fan of Embodiment 6 of the present invention.

In Embodiment 6, as illustrated in FIG. 9, clearance distance i of inlet portion 23 into resonant space 20 is not uniform in a circumferential direction such that one portion thereof is 20 mm and the other portion thereof is 14 mm.

By this configuration, axial depth length La of inlet portion region 24 that is surrounded by cylindrical pipe shaped wall body 22 and orifice 19 and is equivalent to throat portion length L of a Helmholtz resonator is different in a circumferential direction. Hence, by an operation of the Helmholtz resonator, noises at a plurality of frequencies can be resonated and suppressed in resonant space 20.

Embodiment 7

Embodiment 7 of the present invention will be described next. Description of similar parts to those of Embodiment 1 of the present invention is not given, and only the parts that are unique to Embodiment 7 will be described.

Figure 10:
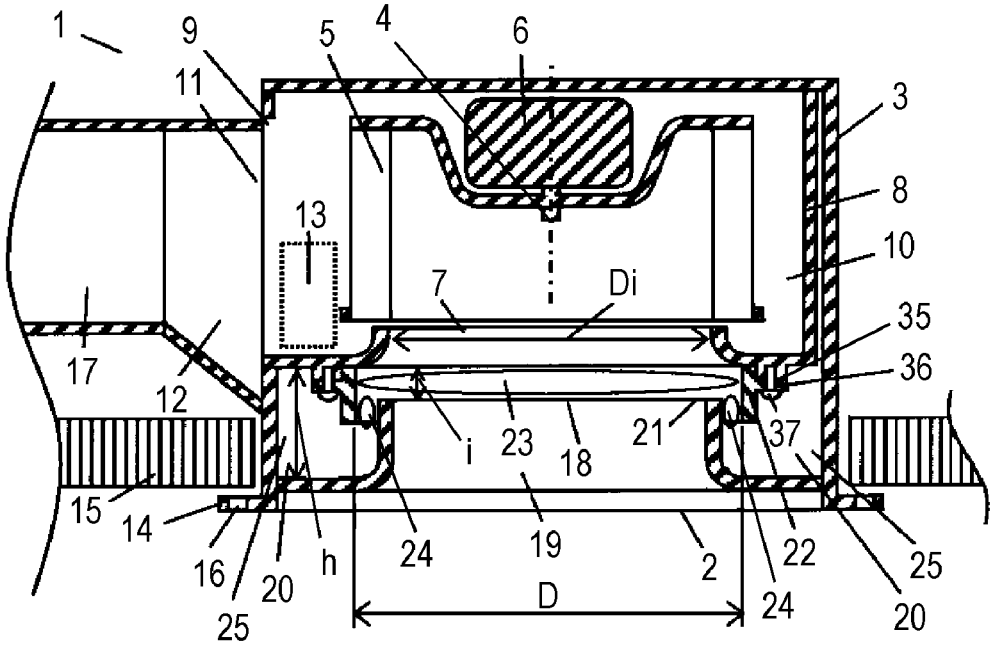
FIG. 10 is a side sectional view illustrating a centrifugal fan of Embodiment 7 of the present invention.

In Embodiment 7, as illustrated in FIG. 10, screwed portion 35 is provided on the lower surface of casing 10, and cylindrical pipe shaped wall body 22 having screwing portion 36 is detachably fixed by screw 37. Cylindrical pipe shaped wall body 22 having different inside diameter D can be attached thereto.

By this configuration, even if frequencies of noises emitted from suction port 7 are changed according to an installed state of centrifugal fan 1, the frequencies at which noises are suppressed can be adjusted by changing inside diameter D of cylindrical pipe shaped wall body 22.

Embodiment 8

Embodiment 8 of the present invention will be described next. Description of similar parts to those of Embodiment 1 of the present invention is not given, and only the parts that are unique to Embodiment 8 will be described.

Figure 11:
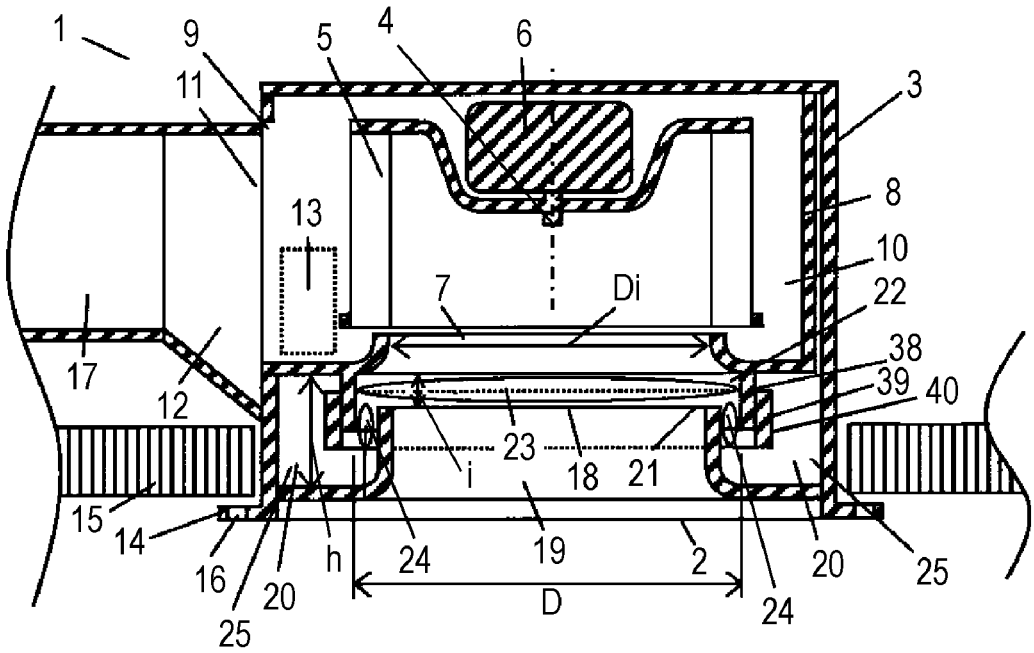
FIG. 11 is a side sectional view illustrating a centrifugal fan of Embodiment 8 of the present invention.

In Embodiment 8, as illustrated in FIG. 11, cylindrical pipe shaped wall body 22 that is provided in resonant space 20 and is concentric with suction port 7 is a double pipe 40 having inside wall 38 and outside wall 39. A height of wall body 22 can be adjusted by sliding outside wall 39.

By this configuration, even if frequencies of noises emitted from suction port 7 are changed according to an operation state of centrifugal fan 1, the frequencies at which noises are suppressed can be adjusted by changing the height of cylindrical pipe shaped wall body 22.

Embodiment 9

Embodiment 9 of the present invention will be described next. Description of similar parts to those of Embodiment 1 of the present invention is not given, and only the parts that are unique to Embodiment 9 will be described.

Figure 12:
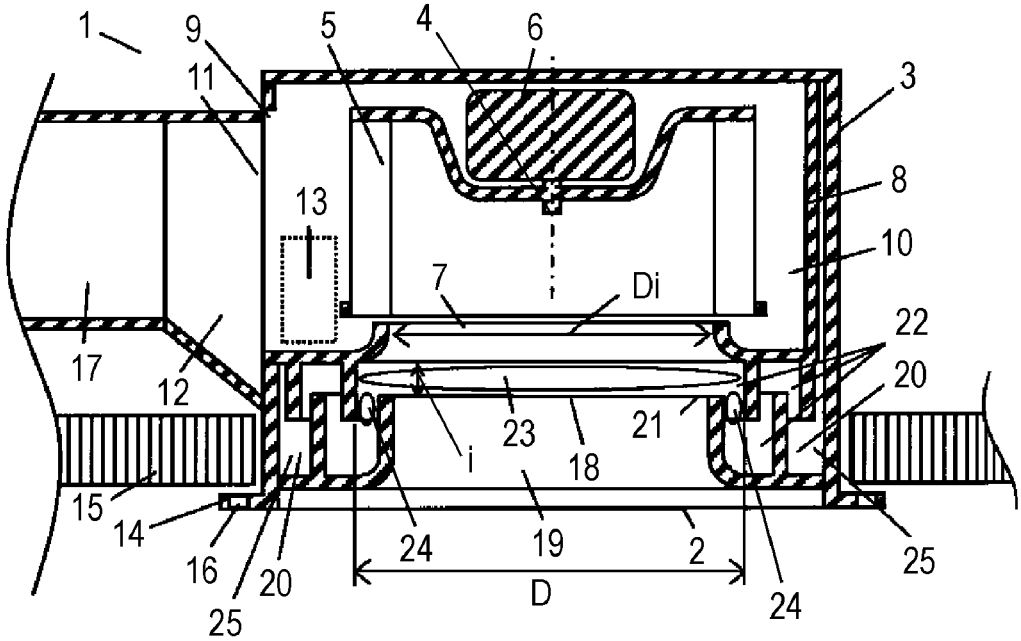
FIG. 12 is a side sectional view illustrating a centrifugal fan of Embodiment 9 of the present invention.

In Embodiment 9, as illustrated in FIG. 12, in cylindrical pipe shaped wall body 22 that is concentric with suction port 7 of casing 10 and has one end contacting casing 10, two wall bodies 22 having wall body inside diameters D of 180 mm and 240 mm and cylindrical pipe shaped wall body 22 that is concentric with suction port 7 of casing 10 and has one end contacting orifice 19 and inside diameter D of 216 mm are arranged in resonant space 20.

By this configuration, centrifugal fan 1 can have a labyrinth structure in which sound waves of noises are propagated so as to alternately move around wall bodies 22 in resonant space 20, and a path where some of sound waves of noises are reflected can be made longer. Hence, noises at a lower frequency can be suppressed without increasing a volume of resonant space 20.

Embodiment 10

Embodiment 10 of the present invention will be described next. Description of similar parts to those of Embodiment 1 of the present invention is not given, and only the parts that are unique to Embodiment 10 will be described.

Figure 13A:
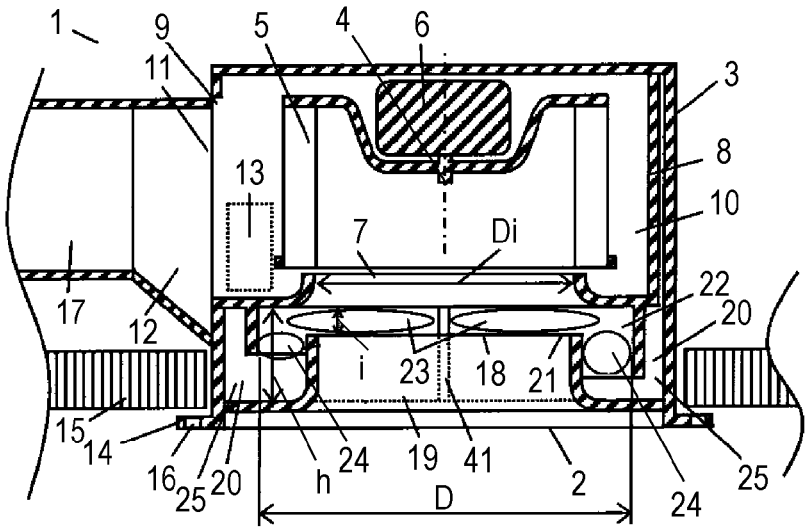
FIG. 13A is a side sectional view illustrating a centrifugal fan of Embodiment 10 of the present invention.
Figure 13B:
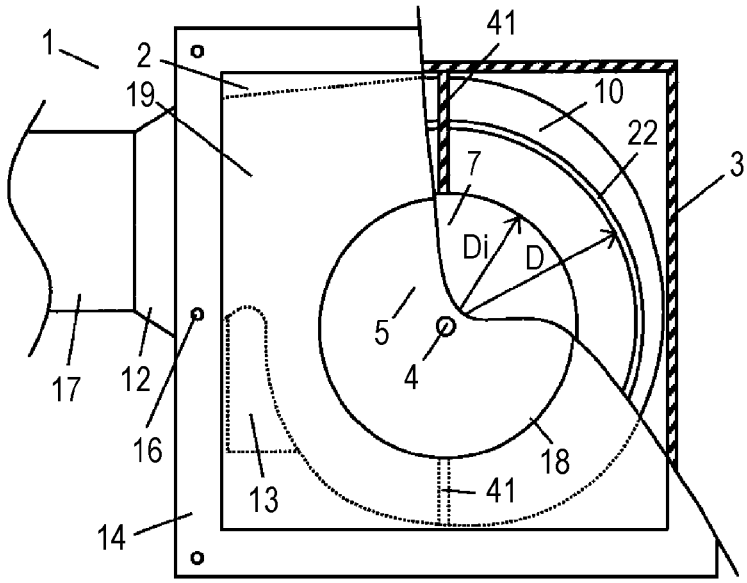
FIG. 13B is a lower surface portion sectional view illustrating the centrifugal fan of Embodiment 10 of the present invention.

In Embodiment 10, as illustrated in FIGS. 13A and 13B, partition wall 41 that divides resonant space 20 into two by different volumes is provided on a plane passing through rotational axis 4, and cylindrical pipe shaped wall body 22 that is concentric with suction port 7 and has one end having a different height and contacting casing 10 is provided in each of resonant spaces 20.

By this configuration, sound waves of noises emitted from suction port 7 are resonated and suppressed in resonant space 20 having a different volume, and part of a path where sound waves of noises are propagated in each of divided resonant spaces 20 can be made longer. Hence, noises at a plurality of lower frequencies can be suppressed without increasing a volume of resonant space 20.

Embodiment 11

Embodiment 11 of the present invention will be described next. Description of similar parts to those of Embodiment 1 of the present invention is not given, and only the parts that are unique to Embodiment 11 will be described.

Figure 14:
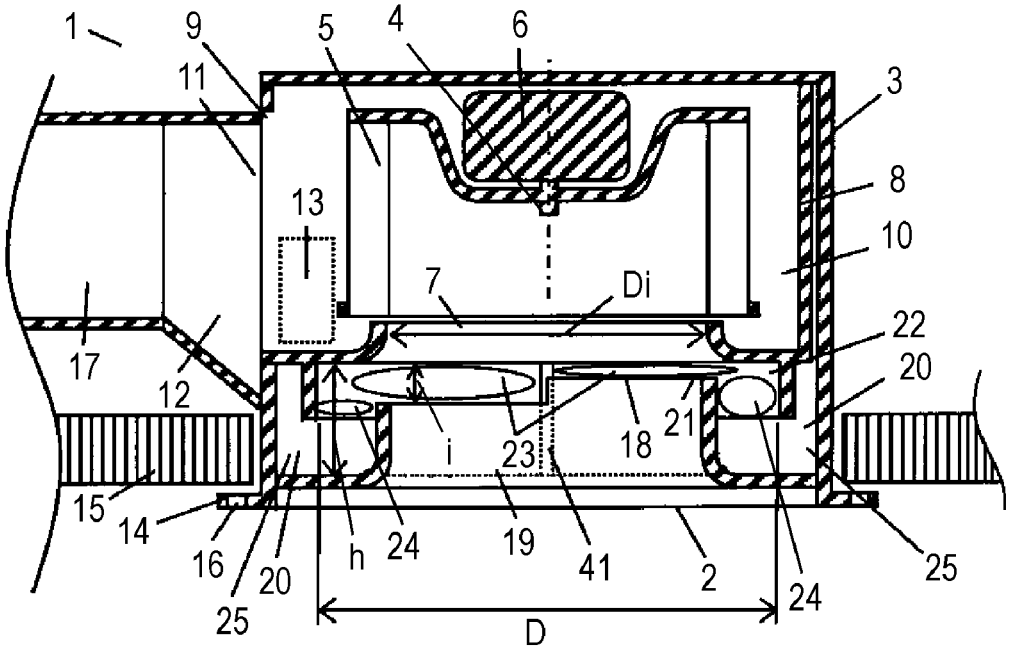
FIG. 14 is a side sectional view illustrating a centrifugal fan of Embodiment 11 of the present invention.

In Embodiment 11, as illustrated in FIG. 14, clearance distances i of inlet portions 23 of resonant spaces 20 divided into two by partition wall 41 are 20 mm and 14 mm, and clearance distances i of inlet portions 23 are different.

By this configuration, a length of inlet portion region 24 that is surrounded by cylindrical pipe shaped wall body 22 and orifice 19 and is equivalent to throat portion length L of a Helmholtz resonator can be set in each of two resonant spaces 20. Hence, by an operation of the Helmholtz resonator, noises at a plurality of lower frequencies can be suppressed without increasing a volume of resonant space 20.

Embodiment 12

Embodiment 12 of the present invention will be described next. Description of similar parts to those of Embodiment 1 of the present invention is not given, and only the parts that are unique to Embodiment 12 will be described.

Figure 15:
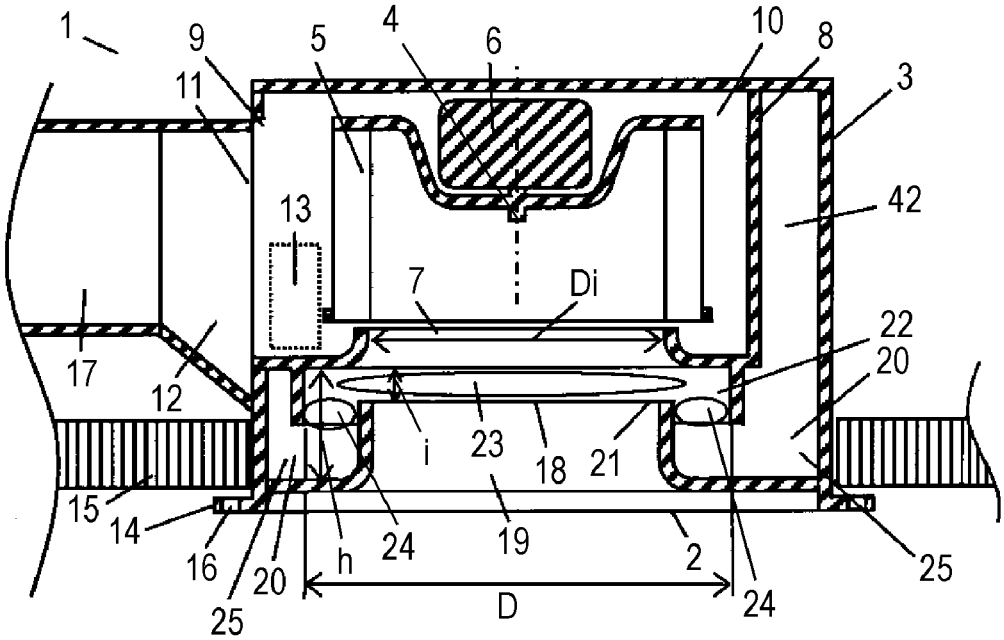
FIG. 15 is a side sectional view illustrating a centrifugal fan of Embodiment 12 of the present invention.

In Embodiment 12, as illustrated in FIG. 15, outer peripheral space 42 that is surrounded by side wall 8 of casing 10 and outer casing 3 communicates with resonant space 20 surrounded by orifice 19, casing 10, and outer casing 3.

By this configuration, outer peripheral space 42 can be used as resonant space 20. Hence, a volume of resonant space 20 can be increased, and a path from inlet portion 23 to the rearmost portion can be made longer. Noises at a lower frequency can thus be suppressed.

Embodiment 13

Embodiment 13 of the present invention will be described next. Description of similar parts to those of Embodiment 1 of the present invention is not given, and only the parts that are unique to Embodiment 13 will be described.

Figure 16:
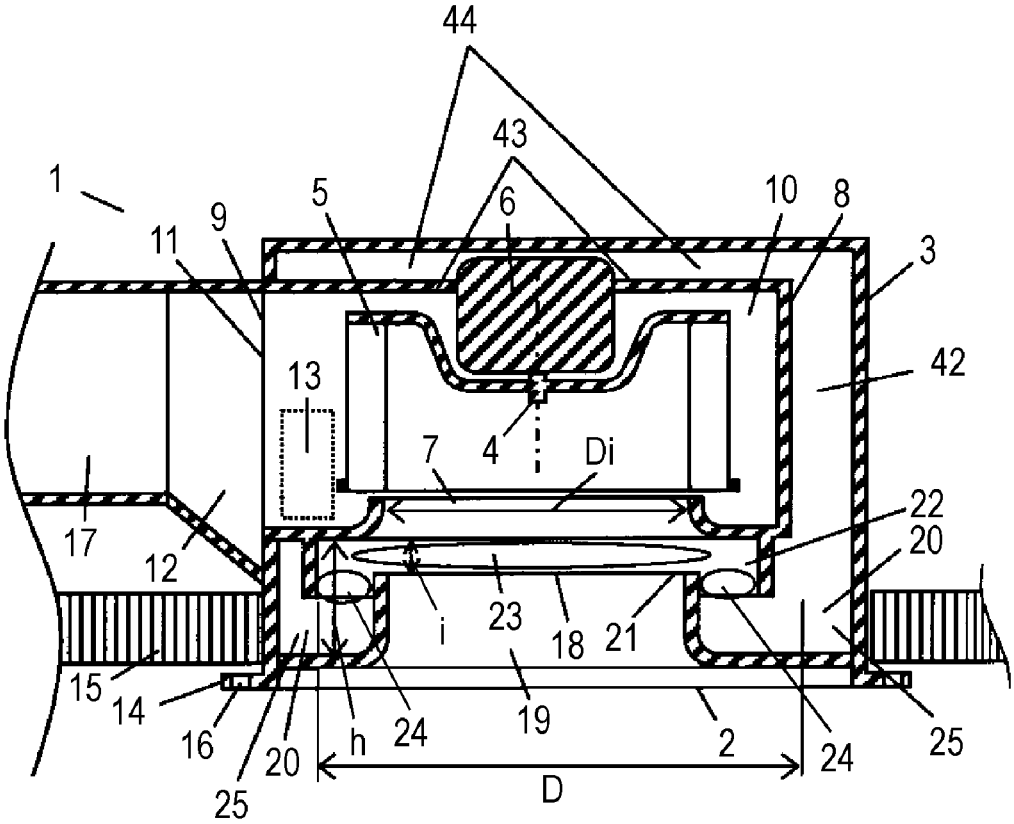
FIG. 16 is a side sectional view illustrating a centrifugal fan of Embodiment 13 of the present invention.

In Embodiment 13, as illustrated in FIG. 16, in centrifugal fan 1 in which part of motor 6 is protruded from casing 10 in outer casing 3, rear space 44 between motor side outer wall 43 of casing 10 and outer casing 3 communicates with outer peripheral space 42 surrounded by side wall 8 of casing 10 and outer casing 3, and outer peripheral space 42 communicates with resonant space 20 surrounded by orifice 19, casing 10, and outer casing 3.

By this configuration, rear space 44 and outer peripheral space 42 can be used as resonant space 20. Hence, a volume of resonant space 20 can be increased, a path from inlet portion 23 to the rearmost portion can be made longer, and noises at a lower frequency can be suppressed.

Embodiment 14

Embodiment 14 of the present invention will be described next. Description of similar parts to those of Embodiment 1 of the present invention is not given, and only the parts that are unique to Embodiment 14 will be described.

Figure 17A:
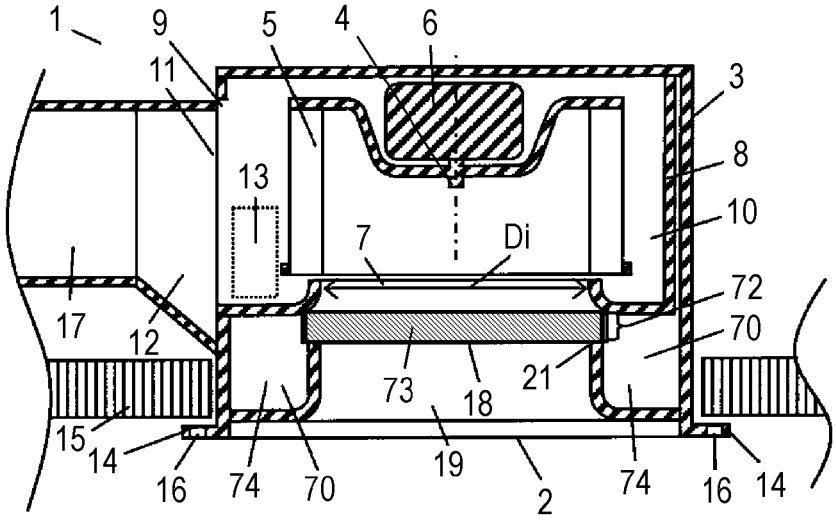
FIG. 17A is a side sectional view illustrating a centrifugal fan of Embodiment 14 of the present invention.
Figure 17B:
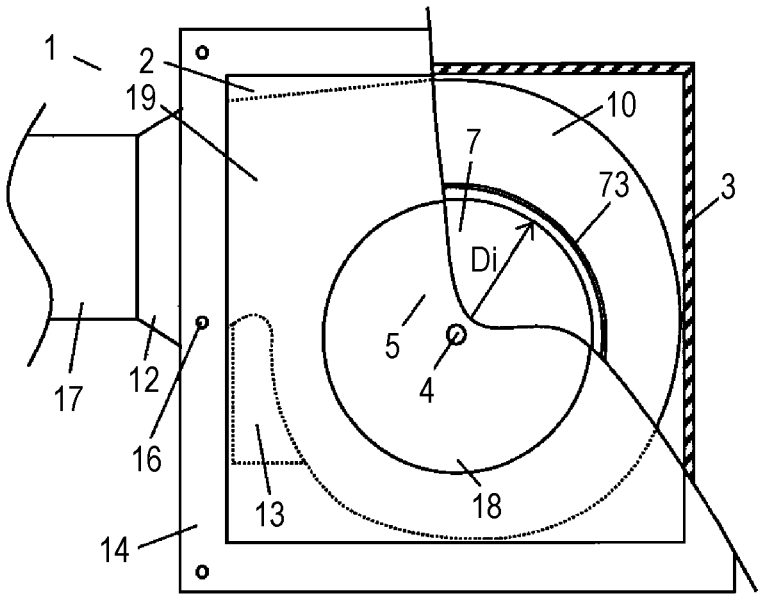
FIG. 17B is a lower surface portion sectional view illustrating the centrifugal fan of Embodiment 14 of the present invention.

In Embodiment 14, as illustrated in FIGS. 17A and 17B, centrifugal fan 1 used as a ceiling burying type ventilating fan includes, in outer casing 3 having an inner dimension of 265 mm square, a height of 195 mm, and opening 2 in a lower surface, motor 6 that couples multiblade impeller 5 having a diameter of 180 mm so as to rotate impeller 5 on rotational axis 4, and casing 10 that surrounds a periphery of impeller 5 and has suction port 7 that is bell-mouthed and has suction port inside diameter Di of 150 mm in a lower surface and discharge port 9 on side wall 8. Side wall 8 of casing 10 has a scroll shape in which an air path is gradually expanded toward discharge port 9. Discharge port 9 of casing 10 communicates with discharge adapter 12 via discharge opening 11 provided in one side of outer casing 3. Electric equipment portion 13 that houses an electric component such as a connector or a terminal for electrically connecting motor 6 with an external power supply is arranged in a portion between casing 10 and outer casing 3. Flange portion 14 is provided on an outer periphery of the lower surface of outer casing 3. Outer casing 3 is fixed to ceiling material 15 by a screw or the like through hole 16 provided in flange portion 14. Duct 17 that is disposed on a ceiling and communicates with outdoors is joined to discharge port 9 via discharge adapter 12.

Orifice 19 has bell-mouthed opening 18 that is concentric with suction port 7 of casing 10 and has an inside diameter of 148 mm equal to or smaller than that of suction port 7. Orifice 19 is separated from suction port 7 of casing 10 by 60 mm and closes opening 2 of outer casing 3. Orifice 19 forms space 70 surrounded by casing 10, orifice 19, and outer casing 3. End 21 of orifice 19 is separated from the lower surface of casing 10 by 20 mm to form clearance portion 72. Clearance portion 72 has a vinyl sheet that is filmy material 73 as a member closing clearance portion 72 so as to close clearance portion 72. There is formed a vibration system in which the vinyl sheet that is filmy material 73 as a noise absorbing structural material that is a member closing clearance portion 72 is a mass and space 70 is rear air layer 74 of filmy material 73 so as to be a spring. A filmy noise absorbing structure as a resonance type noise absorbing structure is formed.

Clearance portion 72 is provided between suction port 7 of casing 10 and space 70 such that suction port 7 of casing 10 communicates with space 70. The vinyl sheet as filmy material 73 is provided in communicating clearance portion 72 so as to close clearance portion 72. Suction port 7 and space 70 are blocked. Space 70 is rear air layer 74 of filmy material 73.

In the above configuration, when impeller 5 is rotated by motor 6, sucked air passes from opening 2 through opening 18 of orifice 19 of the main body. The sucked air smoothly enters impeller 5 from bell-mouthed suction port 7 of casing 10. The sucked air is subjected to pressure rise by impeller 5. The sucked air passes through an inside of casing 10 in a scroll shape. A dynamic pressure is thereby efficiently converted to a static pressure. The sucked air is discharged to duct 17 by discharge adapter 12 and is then discharged to outdoors. Opening 18 of orifice 19 has a diameter equal to or smaller than inside diameter Di of the suction port of casing 10, has a sufficiently large area, and has a bell mouth shape smoothly introducing the sucked air. Lowering of an aerodynamic performance of centrifugal fan 1 due to pressure loss can thus be prevented.

Sound waves of rotational noises caused when the sucked air is subjected to pressure rise by impeller 5, vortex turbulent noises caused when the sucked air passes through the inside of casing 10, and noises amplified by resonance in casing 10 are emitted downward from suction port 7; however, some of the sound waves of the noises emitted from suction port 7 of casing 10 are incident into the vinyl sheet as filmy material 73 provided in clearance portion 72 configured between end 21 of orifice 19 and casing 10. Opening 18 of orifice 19 is concentric with suction port 7 of casing 10. The diameter of opening 18 of orifice 19 is equal to or smaller than inside diameter Di of the suction port of casing 10. Some of the sound waves of the noises emitted from suction port 7 of casing 10 are easily incident into filmy material 73 provided in clearance portion 72 configured between end 21 of orifice 19 and casing 10. A filmy noise absorbing structure as a resonance type noise absorbing structure is formed by space 70 surrounded by orifice 19, casing 10, and outer casing 3 and the vinyl sheet as filmy material 73 closing clearance portion 72 between end 21 of orifice 19 and the lower surface of casing 10. When frequencies of the sound waves of the noises incident into the vinyl sheet as filmy material 73 coincides with a resonance frequency of the vibration system of the filmy noise absorbing structure, the vinyl sheet as filmy material 73 is vibrated to absorb the sound waves by internal friction, thereby suppressing some of the noises. Frequencies at which noises can be suppressed by an operation of the filmy noise absorbing structure can be changed according to a thickness, surface density, and mass of filmy material 73, a tension to provide filmy material 73, a thickness of rear air layer 74, and the like. A range of frequencies of noises in which noises can be suppressed can thus be increased.

Cellophane, an aluminum film, and a polyethylene film, or the like, in addition to the vinyl sheet, may be used as filmy material 73, which can provide a similar effect.

Space 70 to be rear air layer 74 has only to be surrounded by the structure so as to form the resonance type noise absorbing structure. Even if there is a clearance communicating with outside to some extent, a similar effect can be obtained, although a degree of the effect is inferior.

In this configuration, space 70 formed by orifice 19 is formed so as to be surrounded by orifice 19, casing 10, and outer casing 3. Space 70 may be surrounded by other structures of products equipped with orifice 19 and centrifugal fan 1, e.g., a filter, a heater, an electric component, and a case of an electric component. As long as there is formed a vibration system in which space 70 is rear air layer 74 of filmy material 73 so as to be a spring and a filmy noise absorbing structure as a resonance type noise absorbing structure is thus formed, a similar effect can be obtained.

Centrifugal fan 1 may be horizontally installed on a wall, not on a ceiling. In this case also, a similar effect can be obtained.

Embodiment 15

Embodiment 15 of the present invention will be described. Description of similar parts to those of Embodiment 14 of the present invention is not given, and only the parts that are unique to Embodiment 15 will be described.

Figure 18:
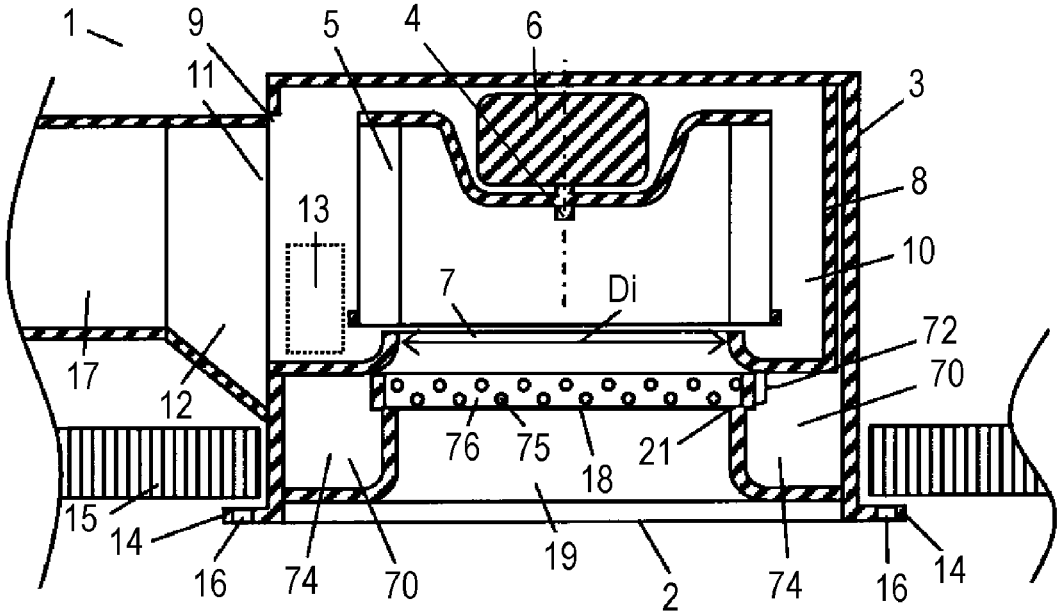
FIG. 18 is a side sectional view illustrating a centrifugal fan of Embodiment 15 of the present invention.

In Embodiment 15, as illustrated in FIG. 18, a hard fiberboard that has a hole area rate of 10% and a large number of small holes 75 having a diameter of 5 mm is provided so as to close clearance portion 72 as holed plate 76.

By this configuration, there is formed a vibration system in which air in small holes 75 of holed plate 76 is a mass and space 70 as rear air layer 74 surrounded by orifice 19, casing 10, and outer casing 3 is a spring. A holed plate noise absorbing structure that absorbs noises according to the same principle as a Helmholtz resonator and is a resonance type noise absorbing structure is formed. When some of sound waves of noises emitted from suction port 7 of casing 10 are incident into holed plate 76, an energy of the incident sound waves of the noises at a frequency that coincides with a resonance frequency of the vibration system of the holed plate noise absorbing structure is absorbed by friction loss due to severe vibration of air in small holes 75. Hence, some of the noises can be suppressed. Frequencies at which noises can be suppressed by an operation of the holed plate noise absorbing structure can be changed according to a plate thickness and a hole area rate of holed plate 76, a diameter and a pitch of small holes 75, and a thickness of rear air layer 74. A range of frequencies of noises in which noises can be suppressed can thus be increased.

A plasterboard or an aluminum plate, in addition to the hard fiberboard, may be used as holed plate 76, which can provide a similar effect.

A plate having a large number of slit-like slots, not holed plate 76 having a large number of circular small holes 75, can provide a similar effect.

Embodiment 16

Embodiment 16 of the present invention will be described next. Description of similar parts to those of Embodiment 14 of the present invention is not given, and only the parts that are unique to Embodiment 16 will be described.

Figure 19:
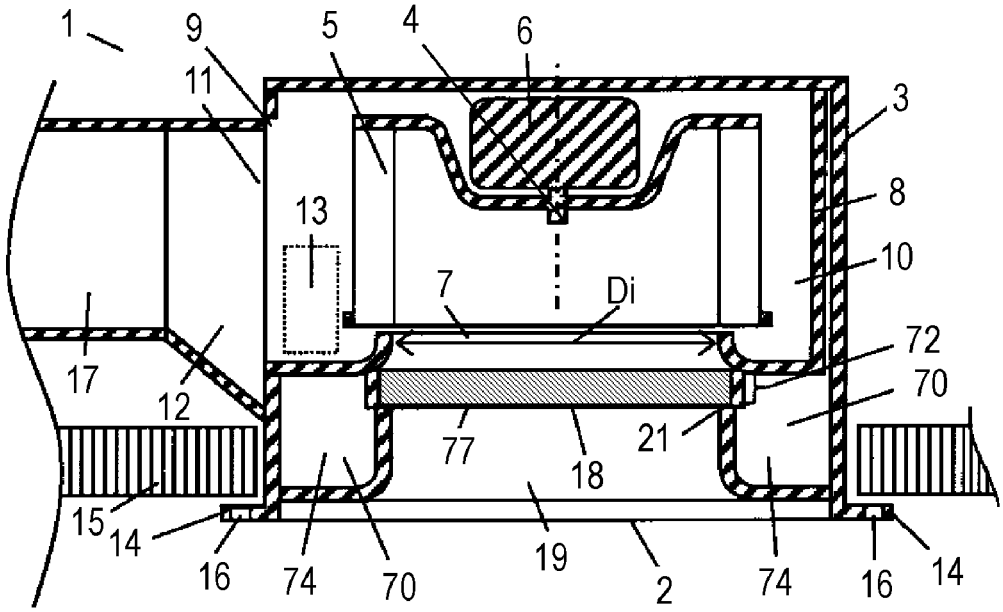
FIG. 19 is a side sectional view illustrating a centrifugal fan of Embodiment 16 of the present invention.

In Embodiment 16, as illustrated in FIG. 19, a soft urethane foam is provided as porous material 77 so as to close clearance portion 72.

By this configuration, some of sound waves of noises emitted from suction port 7 of casing 10 incident into porous material 77, at a frequency depending on noise absorption properties of porous material 77 itself can be absorbed. The sound waves of the noises that pass through porous material 77 and are reflected by orifice 19, casing 10, and outer casing 3 are incident into porous material 77 again so as to be absorbed. There is formed a vibration system in which porous material 77 is a mass and space 70 as rear air layer 74 surrounded by orifice 19, casing 10, and outer casing 3 is a spring. A porous noise absorbing structure as a resonance type noise absorbing structure is thus formed. Energy of the incident sound waves of the noises at a frequency that coincides with a resonance frequency of the vibration system of the porous noise absorbing structure is absorbed by friction loss due to vibration of porous material 77 itself and air in porous material 77. Hence, some of the noises can be suppressed. Frequencies at which noises can be suppressed by an operation of the porous noise absorbing structure can be changed according to, e.g., a material, a thickness, and noise absorption properties of porous material 77, a thickness of rear air layer 74, and by overlapping of porous materials 77 having different noise absorption properties. A range of frequencies of noises in which noises can be suppressed can thus be increased.

Typically, frequencies of noises at which noises can be absorbed by porous material 77 are relatively high, and frequencies of noises at which noises can be suppressed by the porous noise absorbing structure are relatively low. A range of frequencies of noises in which noises can be suppressed at the same time can thus be increased.

Glass wool or rock wool, in addition to the soft urethane foam, may be used as porous material 77, which can provide a similar effect.

Porous material 77 may be covered with a material, such as a cloth, that transmits sound waves in order to prevent scattering of porous material 77. In this case also, a similar effect can be obtained.

A material having noise absorption properties, in addition to porous material 77, e.g., a porous molded plate material such as a rock wool plate or a flexible material such as sponge may also be applied. In this case also, a similar effect can be obtained.

Embodiment 17

Embodiment 17 of the present invention will be described next. Description of similar parts to those of Embodiment 14 of the present invention is not given, and only the parts that are unique to Embodiment 17 will be described.

Figure 20A:
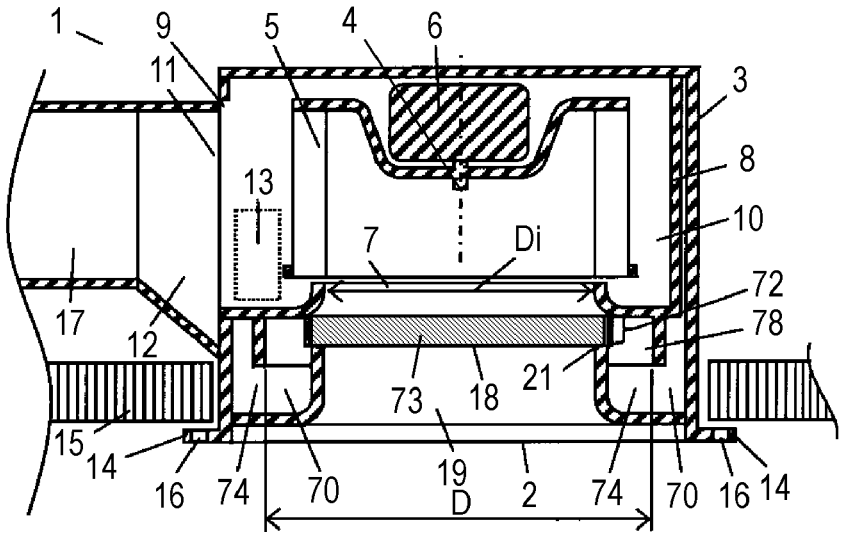
FIG. 20A is a side sectional view illustrating a centrifugal fan of Embodiment 17 of the present invention.
Figure 20B:
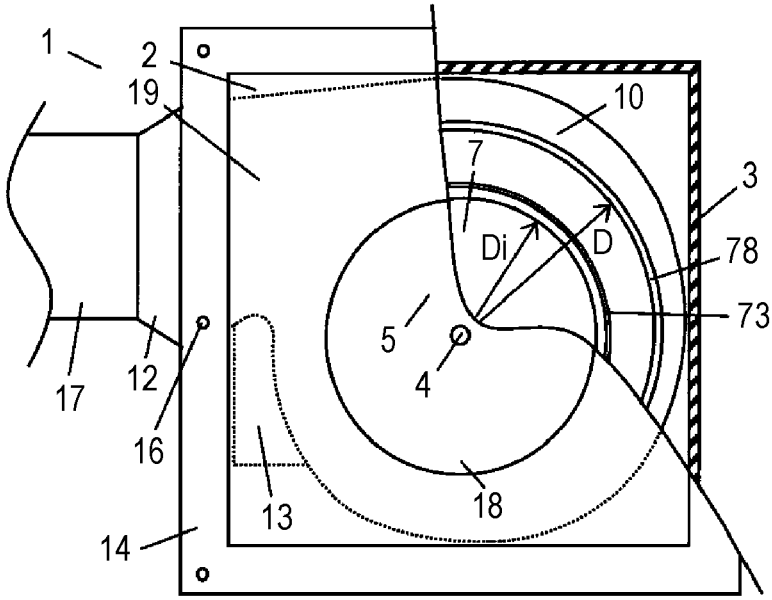
FIG. 20B is a lower surface portion sectional view illustrating the centrifugal fan of Embodiment 17 of the present invention.

In Embodiment 17, as illustrated in FIGS. 20A and 20B, a vinyl sheet as filmy material 73 so as to close clearance portion 72 is provided, and there is formed a vibration system in which the vinyl sheet as filmy material 73 is a mass and space 70 is rear air layer 74 of filmy material 73 so as to be a spring. In centrifugal fan 1 formed with a filmy noise absorbing structure as a resonance type noise absorbing structure, cylindrical pipe shaped wall body 78 concentric with suction port 7 of casing 10 is integrally provided in the lower surface of casing 10. Cylindrical pipe shaped wall body 78 has a thickness of 2 mm and a height of 28 mm, and inside diameter D of the wall body is 216 mm.

There has typically been known that frequencies at which noises can be suppressed by the filmy noise absorbing structure are inversely proportional to a square root of a thickness of rear air layer 74. By this configuration, a length of a path where sound waves of noises are propagated so as to move around wall body 78 in space 70 can be regarded as the thickness of rear air layer 74. Hence, the thickness of rear air layer 74 can be increased, and the frequencies of noises at which noises can be suppressed can be reduced. Noises at a lower frequency can thus be suppressed without changing a size of outer casing 3.

Cylindrical pipe shaped wall body 78 has a cylindrical pipe shape that is concentric with suction port 7 and has one end integrated with casing 10. Accordingly, a path where sound waves of noises move around wall body 78 in space 70 has only one U-shaped curve. Hence, sound waves of noises can be smoothly propagated, and the thickness of rear air layer 74 can be increased more stably. Noises at a lower frequency can be suppressed without changing the size of outer casing 3 by wall body 78 of a simple configuration.

In this configuration, clearance portion 72 is closed by filmy material 73. When clearance portion 72 is closed by holed plate 76, frequencies of noises suppressed by the holed plate noise absorbing structure are inversely proportional to the square root of the thickness of rear air layer 74. Frequencies that can be suppressed can thus be reduced. When clearance portion 72 is closed by porous material 77, the frequencies of noises suppressed by the porous noise absorbing structure is inversely proportional to the thickness of rear air layer 74. The frequencies at which noises can be suppressed can thus be reduced likewise.

In addition, cylindrical pipe shaped wall body 78 may have a shape that can increase the path of sound waves in space 70 and bend the path in a U-shape on a cross section passing through rotational axis 4. Cylindrical pipe shaped wall body 78 may have a polygonal pipe shape or an oval pipe shape. Even if cylindrical pipe shaped wall body 78 is not concentric with suction port 7 of casing 10, a similar effect can be obtained.

Embodiment 18

Embodiment 18 of the present invention will be described next. Description of similar parts to those of Embodiment 14 of the present invention is not given, and only the parts that are unique to Embodiment 18 will be described.

Figure 21:
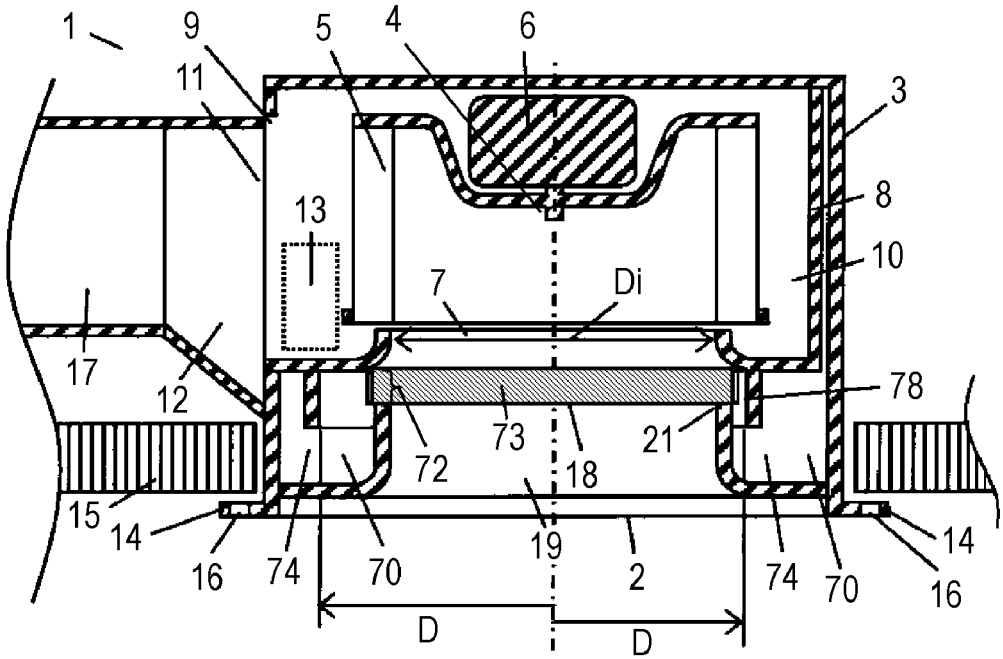
FIG. 21 is a side sectional view illustrating a centrifugal fan of Embodiment 18 of the present invention.

In Embodiment 18, as illustrated in FIG. 21, a vinyl sheet as filmy material 73 so as to close clearance portion 72 is provided, and there is formed a vibration system in which the vinyl sheet as filmy material 73 is a mass and space 70 is rear air layer 74 of filmy material 73 so as to be a spring. In centrifugal fan 1 formed with a filmy noise absorbing structure as a resonance type noise absorbing structure, cylindrical pipe shaped wall body 78 concentric with suction port 7 of casing 10 is integrally provided in the lower surface of casing 10. Cylindrical pipe shaped wall body 78 has a thickness of 2 mm and a height of 28 mm. Inside diameter D of the wall body is not uniform in a circumferential direction such that one portion thereof is 216 mm and the other portion thereof is 160 mm.

By this configuration, inside diameter D of the cylindrical pipe shaped wall body is partially different. A portion where a thickness of rear air layer 74 is different can thus be provided. Hence, noises at a plurality of frequencies can be suppressed, and a range of frequencies of noises in which noises can be suppressed can be increased.

Embodiment 19

Embodiment 19 of the present invention will be described next. Description of similar parts to those of Embodiment 14 of the present invention is not given, and only the parts that are unique to Embodiment 19 will be described.

Figure 22:
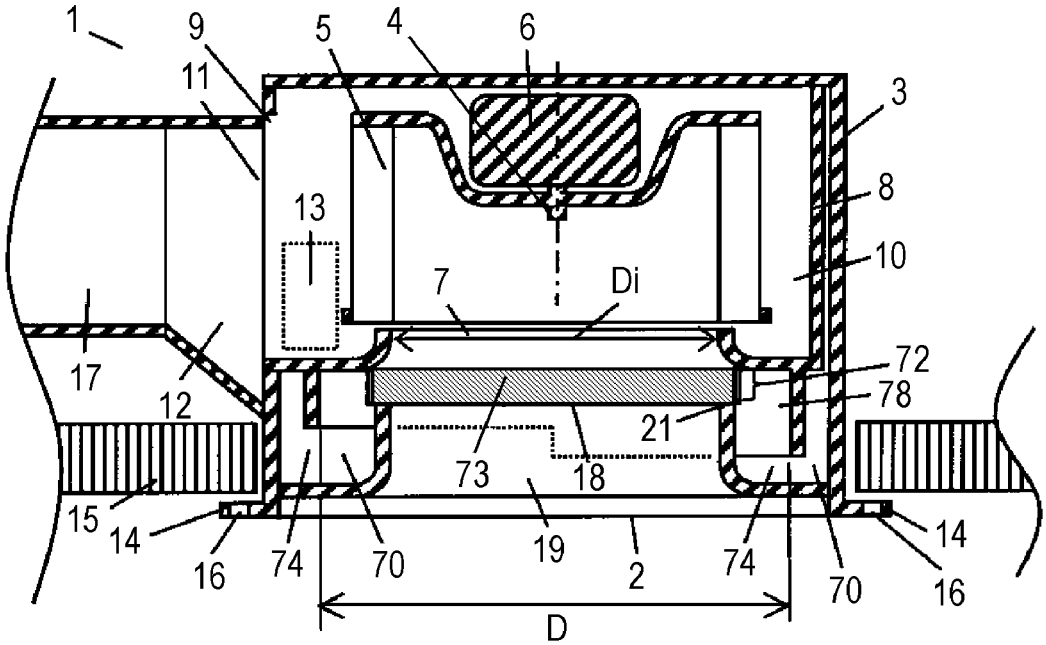
FIG. 22 is a side sectional view illustrating a centrifugal fan of Embodiment 19 of the present invention.

In Embodiment 19, as illustrated in FIG. 22, a vinyl sheet as filmy material 73 so as to close clearance portion 72 is provided, and there is formed a vibration system in which the vinyl sheet as filmy material 73 is a mass and space 70 is rear air layer 74 of filmy material 73 so as to be a spring; therefore, in centrifugal fan 1 formed with a filmy noise absorbing structure as a resonance type noise absorbing structure, cylindrical pipe shaped wall body 78 concentric with suction port 7 of casing 10 is integrally provided in the lower surface of casing 10. Cylindrical pipe shaped wall body 78 has a thickness of 2 mm and inside diameter D of the wall body of 216 mm. A height is not uniform in a circumferential direction such that one portion thereof is 28 mm and the other portion thereof is 40 mm.

By this configuration, the height of cylindrical pipe shaped wall body 78 is partially different. A portion where a thickness of rear air layer 74 is different can thus be provided. Hence, noises at a plurality of frequencies can be suppressed, and a range of frequencies of noises in which noises can be suppressed can be increased.

Embodiment 20

Embodiment 20 of the present invention will be described next. Description of similar parts to those of Embodiment 14 of the present invention is not given, and only the parts that are unique to Embodiment 20 will be described.

Figure 23:
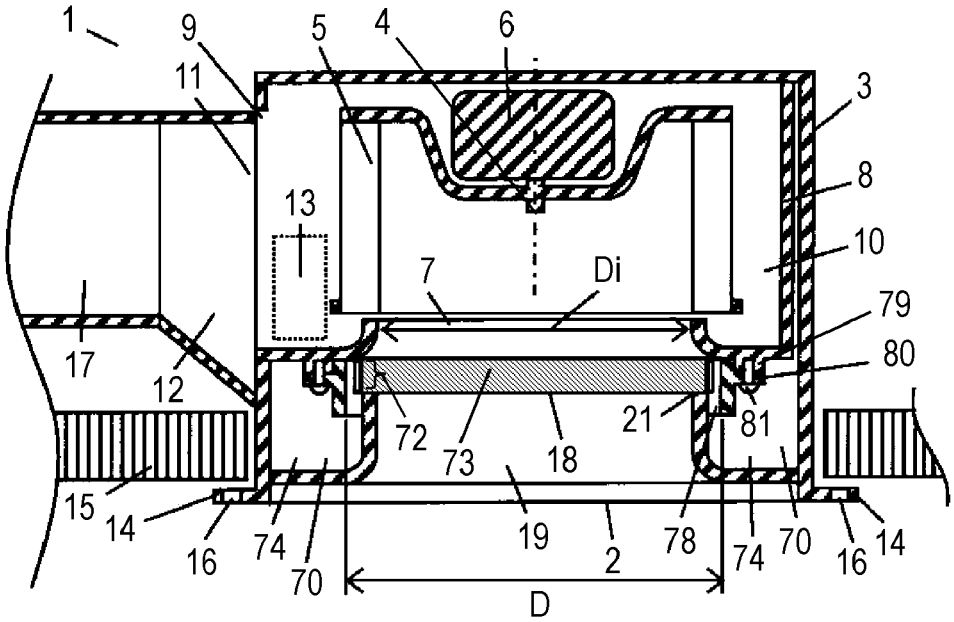
FIG. 23 is a side sectional view illustrating a centrifugal fan of Embodiment 20 of the present invention.

In Embodiment 20, as illustrated in FIG. 23, a vinyl sheet as filmy material 73 so as to close clearance portion 72 is provided, and there is formed a vibration system in which the vinyl sheet as filmy material 73 is a mass and space 70 is rear air layer 74 of filmy material 73 so as to be a spring; therefore, in centrifugal fan 1 formed with a filmy noise absorbing structure as a resonance type noise absorbing structure, screwed portion 79 is provided in the lower surface of casing 10, and cylindrical pipe shaped wall body 78 having screwing portion 80 is detachably fixed to the lower surface of casing 10 by screw 81. Cylindrical pipe shaped wall body 78 having different inside diameter D of the wall body can thus be attached.

By this configuration, even if frequencies of noises emitted from suction port 7 are changed according to an installed state of centrifugal fan 1 or the like, a thickness of rear air layer 74 can be adjusted by changing inside diameter D of the cylindrical pipe shaped wall body. Frequencies of noises at which noises can be suppressed can thus be adjusted.

Embodiment 21

Embodiment 21 of the present invention will be described next. Description of similar parts to those of Embodiment 14 of the present invention is not given, and only the parts that are unique to Embodiment 21 will be described.

Figure 24:
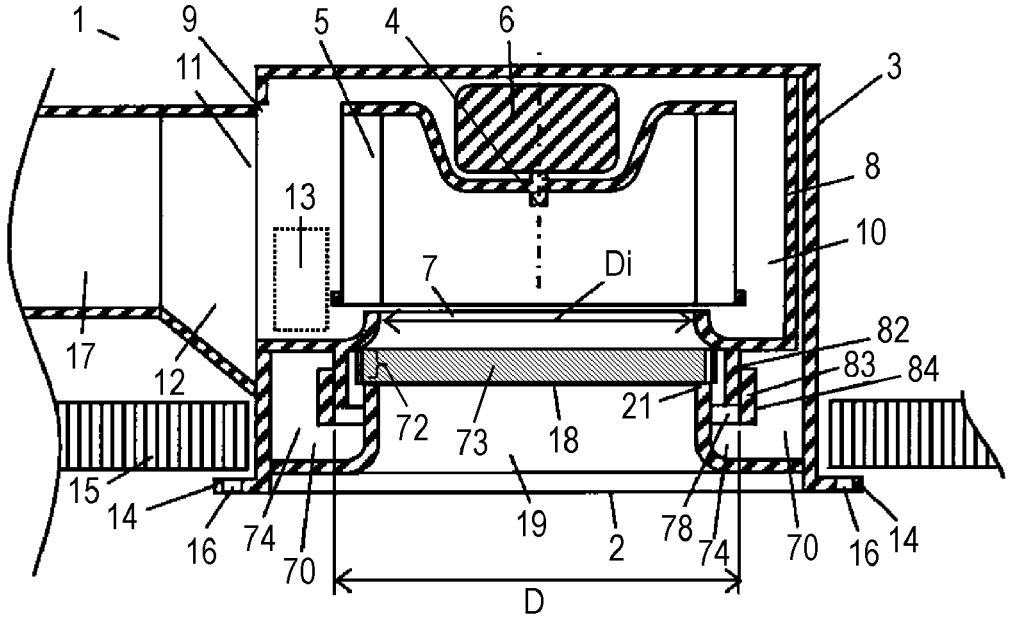
FIG. 24 is a side sectional view illustrating a centrifugal fan of Embodiment 21 of the present invention.

In Embodiment 21, as illustrated in FIG. 24, a vinyl sheet as filmy material 73 so as to close clearance portion 72 is provided, and there is formed a vibration system in which the vinyl sheet as filmy material 73 is a mass and space 70 is rear air layer 74 of filmy material 73 so as to be a spring; therefore, in centrifugal fan 1 formed with a filmy noise absorbing structure as a resonance type noise absorbing structure, cylindrical pipe shaped wall body 78 that is provided in space 70 and is concentric with suction port 7 is double pipe 84 having inside wall 82 and outside wall 83. A height of wall body 78 can be adjusted by sliding outside wall 83.

By this configuration, a thickness of rear air layer 74 can be adjusted by adjusting the height of cylindrical pipe shaped wall body 78. Frequencies of noises at which noises can be suppressed can thus be adjusted.

Embodiment 22

Embodiment 22 of the present invention will be described next. Description of similar parts to those of Embodiment 14 of the present invention is not given, and only the parts that are unique to Embodiment 22 will be described.

Figure 25:
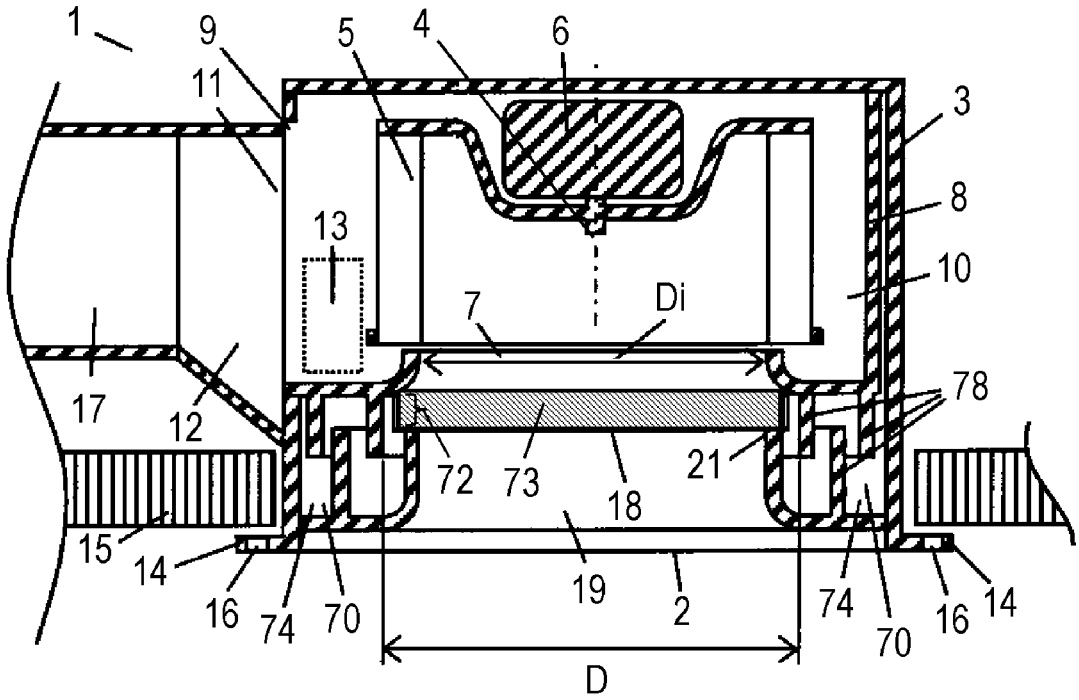
FIG. 25 is a side sectional view illustrating a centrifugal fan of Embodiment 22 of the present invention.

In Embodiment 22, as illustrated in FIG. 25, a vinyl sheet as filmy material 73 so as to close clearance portion 72 is provided, and there is formed a vibration system in which the vinyl sheet as filmy material 73 is a mass and space 70 is rear air layer 74 of filmy material 73 so as to be a spring; therefore, in centrifugal fan 1 formed with a filmy noise absorbing structure as a resonance type noise absorbing structure, in cylindrical pipe shaped wall body 78 that is concentric with suction port 7 of casing 10 and has one end contacting casing 10, there are arranged two wall bodies 78 having wall body inside diameters D of 180 mm and 240 mm and cylindrical pipe shaped wall body 78 that is concentric with suction port 7 of casing 10 and has one end contacting orifice 19 and wall body inside diameter D of 216 mm.

By this configuration, centrifugal fan 1 can have a labyrinth structure in which sound waves of noises are propagated so as to alternately move around wall bodies 78 in space 70. Thus, a thickness of rear air layer 74 can be increased, and noises at a lower frequency can be suppressed without changing a size of outer casing 3.

Embodiment 23

Embodiment 23 of the present invention will be described next. Description of similar parts to those of Embodiment 14 of the present invention is not given, and only the parts that are unique to Embodiment 23 will be described.

Figure 26A:
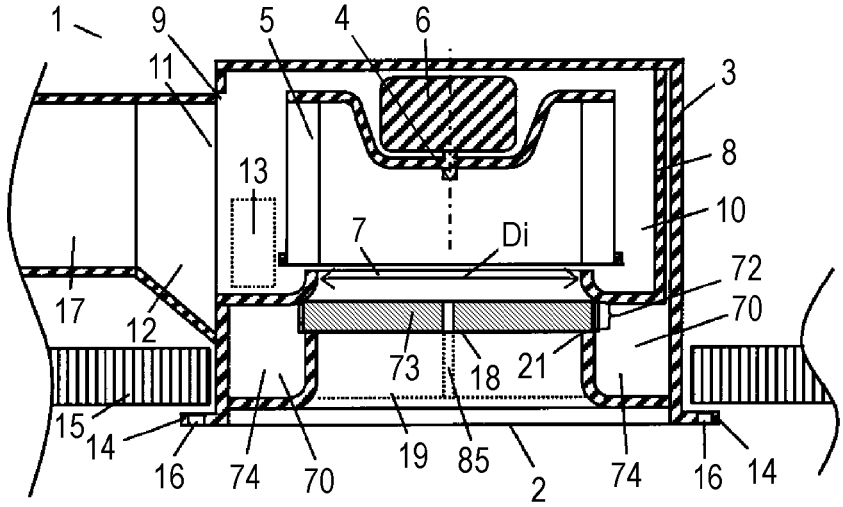
FIG. 26A is a side sectional view illustrating a centrifugal fan of Embodiment 23 of the present invention.
Figure 26B:
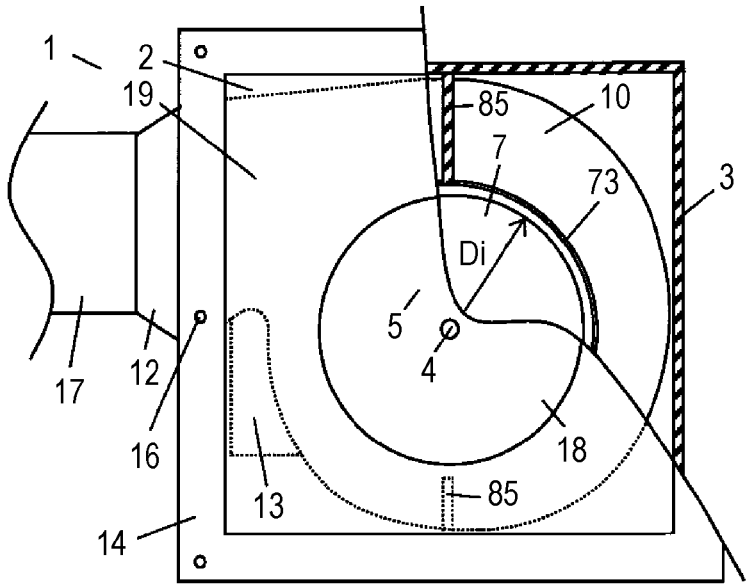
FIG. 26B is a lower surface portion sectional view illustrating a centrifugal fan of Embodiment 23 of the present invention.

In Embodiment 23, as illustrated in FIGS. 26A and 26B, a vinyl sheet as filmy material 73 so as to close clearance portion 72 is provided, and there is formed a vibration system in which the vinyl sheet as filmy material 73 is a mass and space 70 is rear air layer 74 of filmy material 73 so as to be a spring; therefore, in centrifugal fan 1 formed with a filmy noise absorbing structure as a resonance type noise absorbing structure, partition wall 85 that divides space 70 into two by different volumes is provided on a plane passing through rotational axis 4.

By this configuration, a plurality of resonance type noise absorbing structures in which a shape and volume of space 70 as rear air layer 74 are different can be formed. Hence, noises at a plurality of frequencies can be suppressed, and a range of frequencies of noises in which noises can be suppressed can be increased.

Embodiment 24

Embodiment 24 of the present invention will be described next. Description of similar parts to those of Embodiment 14 of the present invention is not given, and only the parts that are unique to Embodiment 24 will be described.

Figure 27:
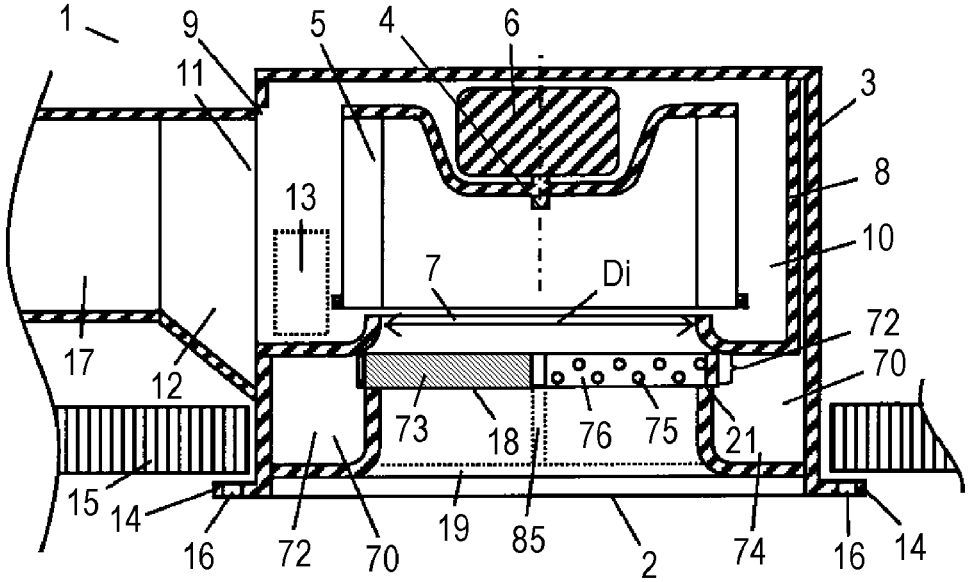
FIG. 27 is a side sectional view illustrating a centrifugal fan of Embodiment 24 of the present invention.

In Embodiment 24, as illustrated in FIG. 27, clearance portion 72 of one of spaces 70 divided into two by partition wall 85 is closed by a vinyl sheet as filmy material 73. Clearance portion 72 of the other space 70 is closed by a hard fiberboard that is holed plate 76 and has a hole area rate of 10% with a large number of small holes 75 having a diameter of 5 mm.

By this configuration, two kinds of resonance type noise absorbing structures can be formed. Thus, noises at a plurality of frequencies can be suppressed, and a range of frequencies of noises in which noises can be suppressed can be increased.

Clearance portion 72 of one of divided spaces 70 may be unclosed and resonant noise-suppression may be performed by air column resonance in space 70.

Embodiment 25

Embodiment 25 of the present invention will be described next. Description of similar parts to those of Embodiment 14 of the present invention is not given, and only the parts that are unique to Embodiment 25 will be described.

Figure 28:
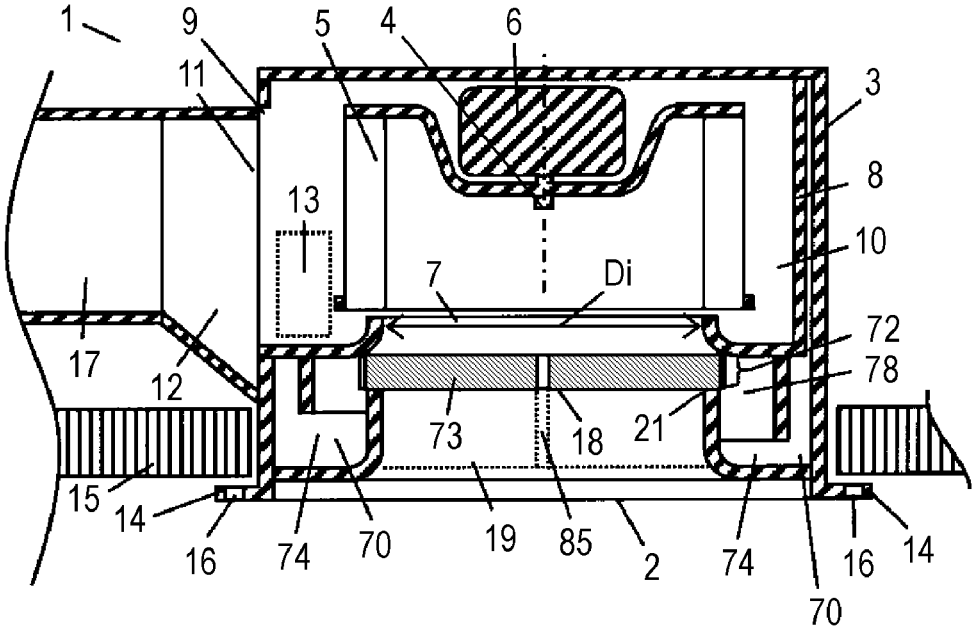
FIG. 28 is a side sectional view illustrating a centrifugal fan of Embodiment 25 of the present invention.

In Embodiment 25, as illustrated in FIG. 28, cylindrical pipe shaped wall body 78 that is concentric with suction port 7 and has one end having a different height contacting casing 10 is provided in each of spaces 70 divided into two by partition wall 85 and a thickness of rear air layer 74 is increased in each of spaces 70.

By this configuration, wall body 78 having a different shape is provided in each of spaces 70 divided into two by partition wall 85 and the resonance type noise absorbing structure in which a thickness of rear air layer 74 is different can be formed in each of divided spaces 70. Hence, noises at a plurality of frequencies can be suppressed, and a range of frequencies of noises in which noises can be suppressed can be increased.

In cylindrical pipe shaped wall body 78 that is provided in each of spaces 70 divided into two by partition wall 85, has one end contacting casing 10, and is concentric with suction port 7, an inside diameter, a thickness, and a combination of these as well as a height, may be different. In this case also, a similar effect can be obtained.

Embodiment 26

Embodiment 26 of the present invention will be described next. Description of similar parts to those of Embodiment 14 of the present invention is not given, and only the parts that are unique to Embodiment 26 will be described.

Figure 29:
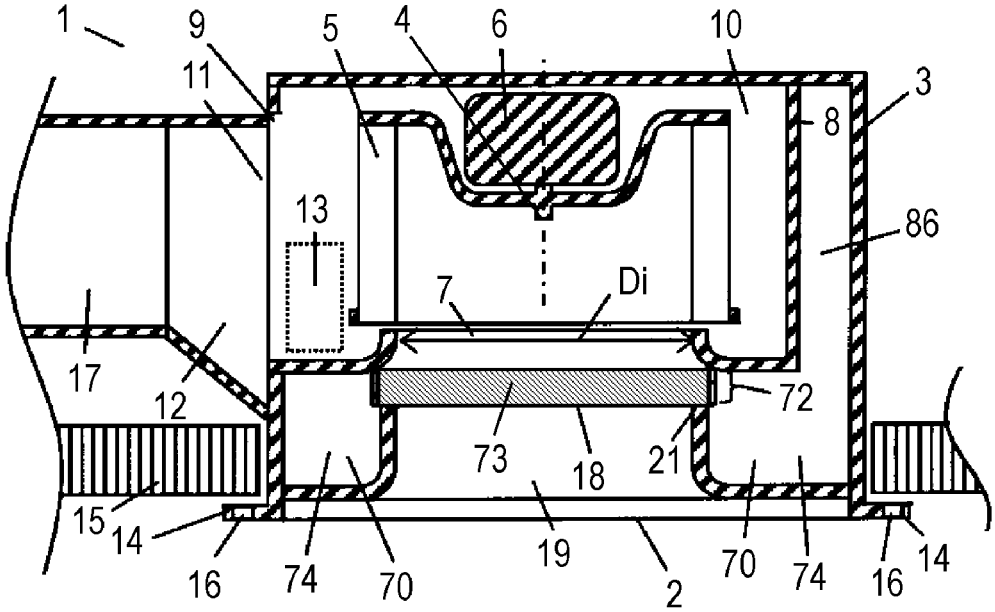
FIG. 29 is a side sectional view illustrating a centrifugal fan of Embodiment 26 of the present invention.

In Embodiment 26, as illustrated in FIG. 29, a vinyl sheet as filmy material 73 so as to close clearance portion 72 is provided, and there is formed a vibration system in which the vinyl sheet as filmy material 73 is a mass and space 70 is rear air layer 74 of filmy material 73 so as to be a spring; therefore, in centrifugal fan 1 formed with a filmy noise absorbing structure as a resonance type noise absorbing structure, outer peripheral space 86 surrounded by side wall 8 of casing 10 and outer casing 3 communicates with space 70 surrounded by orifice 19, casing 10, and outer casing 3.

By this configuration, outer peripheral space 86 can be used as rear air layer 74 of the resonance type noise absorbing structure. Hence, a thickness of rear air layer 74 can be increased, and noises at a lower frequency can be suppressed without changing a size of outer casing 3.

Embodiment 27

Embodiment 27 of the present invention will be described next. Description of similar parts to those of Embodiment 14 of the present invention is not given, and only the parts that are unique to Embodiment 27 will be described.

Figure 30:
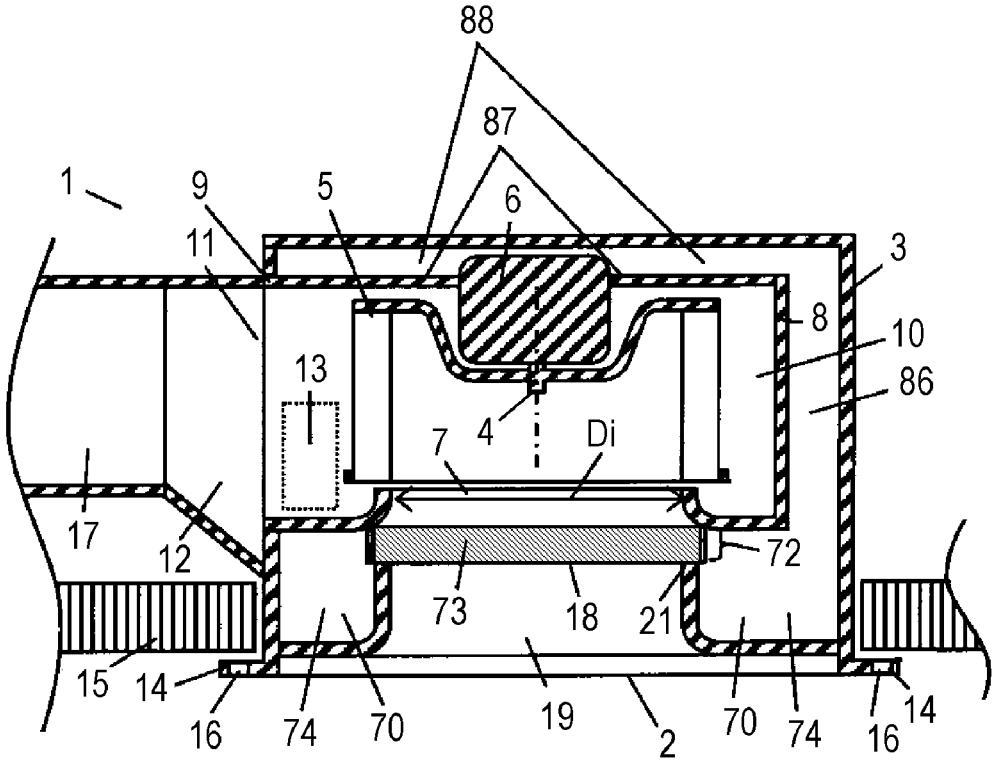
FIG. 30 is a side sectional view illustrating a centrifugal fan of Embodiment 27 of the present invention.
Figure 31:
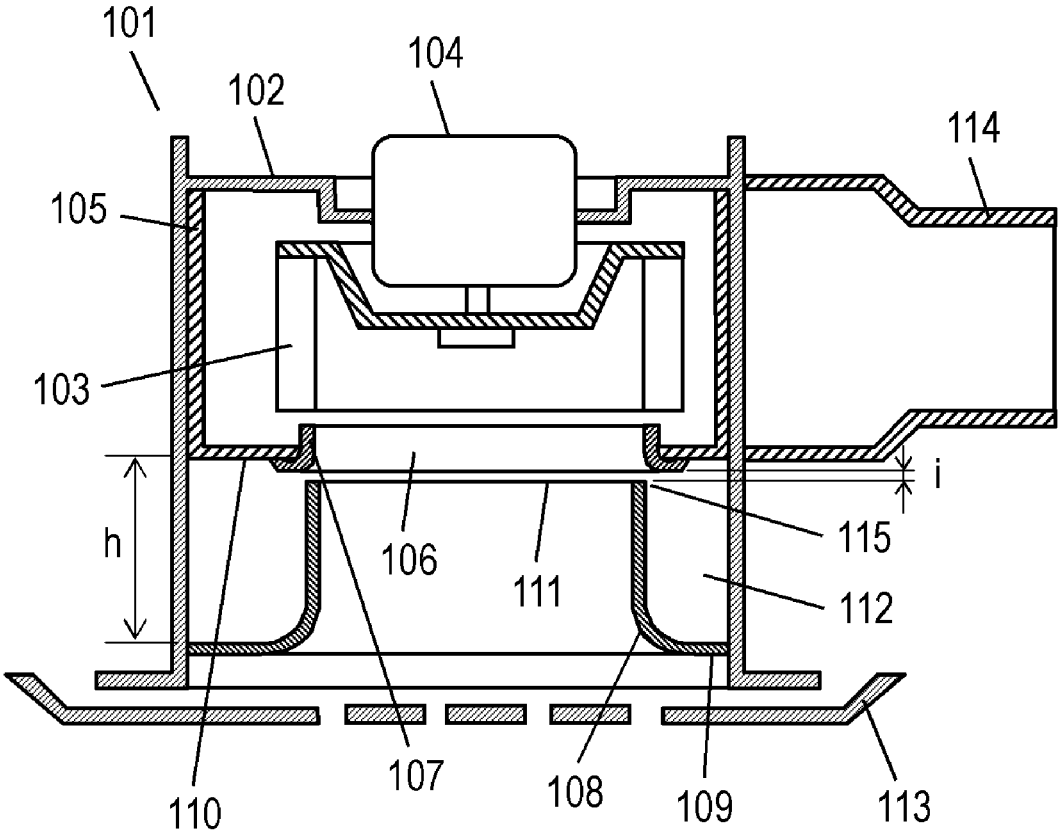
FIG. 31 is a side sectional view illustrating a centrifugal fan in the related art.

In Embodiment 27, as illustrated in FIG. 30, a vinyl sheet as filmy material 73 so as to close clearance portion 72 is provided, and there is formed a vibration system in which the vinyl sheet as filmy material 73 is a mass and space 70 is rear air layer 74 of filmy material 73 so as to be a spring; therefore, in centrifugal fan 1 formed with a filmy noise absorbing structure as a resonance type noise absorbing structure, part of motor 6 is protruded from casing 10 in outer casing 3. Rear space 88 between motor side outer wall 87 of casing 10 and outer casing 3 communicates with outer peripheral space 86 surrounded by side wall 8 of casing 10 and outer casing 3. Outer peripheral space 86 communicates with space 70 surrounded by orifice 19, casing 10, and outer casing 3.

By this configuration, rear space 88 can be used as rear air layer 74 of the resonance type noise absorbing structure together with outer peripheral space 86. Hence, a thickness of rear air layer 74 can be increased, and noises at a lower frequency can be suppressed without changing a size of the outer casing.

INDUSTRIAL APPLICABILITY

The present invention provides a centrifugal fan that can increase a range of frequencies of noises in which noises can be suppressed, can suppress noises at a lower frequency without changing a size of the outer casing, and can adjust frequencies of noises at which noises can be suppressed. The industrial applicability is therefore extremely high.

The invention claimed is:

1. A centrifugal fan comprising, in an outer casing having an opening, a motor that couples an impeller so as to rotate the impeller on a rotational axis, a casing that surrounds a periphery of the impeller and has a suction port, and a bell-mouthed orifice that has an opening communicating with the opening of the outer casing, the centrifugal fan resonating and suppressing noises released from the suction port by a resonant space formed by the orifice, wherein part of a path where sound waves of noises incident from an inlet portion between an end of the orifice and the casing into the resonant space are reflected is made longer, a wall body is provided in the resonant space and the part of the path where sound waves of noises incident into the resonant space are reflected is made longer, and the wall body provided in the resonant space has a cylindrical pipe shape that is concentric with the suction port and has one end contacting the casing.

2. The centrifugal fan according to claim 1, wherein inside diameter D of the cylindrical pipe shaped wall body that is provided in the resonant space and is concentric with the suction port establishes a relation of $D>Di+2i$ between inside diameter Di of the suction port and clearance distance i of the inlet portion.

3. The centrifugal fan according to claim 1, wherein inside diameter D of the cylindrical pipe shaped wall body that is provided in the resonant space and is concentric with the suction port establishes a relation of $D<Di+2i$ between inside diameter Di of the suction port and clearance distance i of the inlet portion.

4. The centrifugal fan according to claim 1, wherein the inside diameter of the cylindrical pipe shaped wall body that is provided in the resonant space and is concentric with the suction port is not uniform in a circumferential direction.

5. The centrifugal fan according to claim 1, wherein a height of the cylindrical pipe shaped wall body that is provided in the resonant space and is concentric with the suction port is not uniform in a circumferential direction.

6. The centrifugal fan according to claim 1, wherein the clearance distance of the inlet portion into the resonant space is not uniform in a circumferential direction.

7. The centrifugal fan according to claim 1, wherein the height of the cylindrical pipe shaped wall body that is provided in the resonant space and is concentric with the suction port is adjustable.

8. The centrifugal fan according to claim 1, wherein at least one cylindrical pipe shaped wall body that is concentric with the suction port of the casing and has one end contacting the casing and at least one cylindrical pipe shaped wall body that is concentric with the suction port of the casing and has one end contacting the orifice are arranged alternately in a diametrical direction.

9. The centrifugal fan according to claim 1, wherein the cylindrical pipe shaped wall body that is provided in the resonant space and is concentric with the suction port is molded integrally with the casing.

10. The centrifugal fan according to claim 1, wherein an outer peripheral space surrounded by a side wall of the casing and the outer casing is used as the resonant space.

11. The centrifugal fan according to claim 10, wherein a rear space between a motor side outer wall of the casing and the outer casing is used as the resonant space.

12. A centrifugal fan comprising, in an outer casing having an opening, a motor that couples an impeller so as to rotate the impeller on a rotational axis, a casing that surrounds a periphery of the impeller and has a suction port, and a bell-mouthed orifice that has an opening communicating with the opening of the outer casing, wherein a member closing a clearance portion between an end of the orifice and the casing is a noise absorbing structural material, and a space formed by the orifice is a rear air layer, to form a resonance type noise absorbing structure, and a wall body provided in the space has a cylindrical pipe shape that is concentric with the suction port and has one end contacting the casing.

13. The centrifugal fan according to claim 12, wherein the opening of the orifice is concentric with the suction port of the casing.

14. The centrifugal fan according to claim 12, wherein the opening of the orifice has a diameter equal to or smaller than that of the suction port.

15. The centrifugal fan according to claim 12, wherein the member closing the clearance portion is a filmy material.

16. The centrifugal fan according to claim 12, wherein the member closing the clearance portion is a holed plate.

17. The centrifugal fan according to claim 12, wherein the member closing the clearance portion is a porous material.

18. The centrifugal fan according to claim 12, wherein thickness of the rear air layer is increased.

19. The centrifugal fan according to claim 12, wherein an inside diameter of the cylindrical pipe shaped wall body that is provided in the space and is concentric with the suction port is not uniform in a circumferential direction.

20. The centrifugal fan according to claim 12, wherein a height of the cylindrical pipe shaped wall body that is provided in the space and is concentric with the suction port is not uniform in a circumferential direction.

21. The centrifugal fan according to claim 12, wherein at least one cylindrical pipe shaped wall body that is concentric with the suction port of the casing and has one end contacting the casing and at least one cylindrical pipe shaped wall body that is concentric with the suction port of the casing and has one end contacting the orifice are arranged alternately in a diametrical direction.

22. The centrifugal fan according to claim 12, wherein an outer peripheral space surrounded by a side wall of the casing and the outer casing is used as the rear air layer.

23. The centrifugal fan according to claim 12, wherein a rear space between a motor side outer wall of the casing and the outer casing is used as the rear air layer.

24. A centrifugal fan comprising:

an outer casing having an opening;

a motor coupled to an impeller to rotate the impeller on a rotational axis;

a casing that surrounds a periphery of the impeller and has a suction port;

an orifice that has an opening communicating with the opening of the outer casing, the orifice forming a resonant space in the outer casing; and a substantially cylindrical pipe shaped wall body located in the resonant space to propagate sound waves of noises incident in resonant space from an inlet portion between an end of the orifice around the wall body and thereby increase a path length of which the sound waves are reflected during fan operation, the wall body being concentric with the orifice and having one end contacting the casing.

* * * * *